US006769758B2

(12) United States Patent
Wanibuchi et al.

(10) Patent No.: US 6,769,758 B2
(45) Date of Patent: Aug. 3, 2004

(54) CLEANING DEVICE AND INK-JET PRINTER

(75) Inventors: Hiroshi Wanibuchi, Shiojiri (JP); Atsushi Nishioka, Shiojiri (JP); Toshiyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/828,312

(22) Filed: Apr. 5, 2001

(65) Prior Publication Data

US 2001/0055043 A1 Dec. 27, 2001

(30) Foreign Application Priority Data

| | | |
|---|---|---|
| Apr. 6, 2000 | (JP) | 2000-104956 |
| Apr. 19, 2000 | (JP) | 2000-118136 |
| Apr. 19, 2000 | (JP) | 2000-118137 |
| Jun. 5, 2000 | (JP) | 2000-167562 |

(51) Int. Cl.[7] ..... B41J 2/165

(52) U.S. Cl. ..... 347/33; 347/22; 347/29; 347/30; 347/31; 347/33

(58) Field of Search ..... 341/22–36

(56) References Cited

U.S. PATENT DOCUMENTS

| | | | | |
|---|---|---|---|---|
| 5,065,158 A | * | 11/1991 | Nojima et al. | 347/33 |
| 5,182,582 A | | 1/1993 | Okamura | |
| 5,608,432 A | | 3/1997 | Yamaguchi | 347/33 |
| 5,663,751 A | * | 9/1997 | Holbrook | 347/22 |
| 5,717,445 A | * | 2/1998 | Kida et al. | 347/33 |
| 5,798,775 A | * | 8/1998 | Takahashi et al. | 347/33 |
| 5,896,143 A | * | 4/1999 | Matsui et al. | 347/24 |
| 5,898,444 A | * | 4/1999 | Kobayashi et al. | 347/29 |
| 5,903,287 A | * | 5/1999 | Ishikawa et al. | 347/24 |
| 6,189,999 B1 | * | 2/2001 | Pham et al. | 347/33 |

FOREIGN PATENT DOCUMENTS

| | | |
|---|---|---|
| EP | 0-916501 | 5/1999 |
| JP | 62-25056 | 2/1987 |
| JP | 62-251145 | 10/1987 |
| JP | 2-286349 | 11/1990 |
| JP | 3-240554 | 10/1991 |
| JP | 04-328521 | * 5/1994 |
| JP | 09-143597 | * 5/1994 |

* cited by examiner

*Primary Examiner*—Stephan D. Meier
*Assistant Examiner*—Ly T Tran
(74) *Attorney, Agent, or Firm*—Hogan & Hartson, LLP

(57) ABSTRACT

A cleaning device for cleaning a nozzle surface of an ink-jet head has a first wiping member for wiping a nozzle surface of an ink-jet head and a second wiping member for wiping the first wiping member, and a lever driving mechanism for moving the first wiping member between a retracted position located away from the nozzle surface and a wiping position for wiping the nozzle surface. The second wiping member is formed of an elastic body and is arranged within a moving path of the first wiping member, so that it contacts with the first wiping member for only a limited period, whereby reducing in wear of these wiping members.

38 Claims, 12 Drawing Sheets

$$\begin{pmatrix} \beta_1 > \alpha_1 \\ \alpha_2 < \beta_2 \end{pmatrix}$$

CLEANING DEVICE AND INK-JET PRINTER

BACKGROUND OF THE INVENTION

1. Field of the Invention

The present invention relates to a cleaning device for wiping a nozzle surface of an ink-jet head in an ink-jet printer, and an ink-jet printer employing the cleaning device.

2. Description of the Related Art

An ink-jet printer performs printing on a printing paper by ejecting ink droplets from respective ink nozzles of an ink-jet head. Upon occurrence of clogging of respective ink nozzles, printing quality can be lowered, and, in worst case, printing becomes impossible. Clogging of the ink nozzle can be caused when the ink in the ink nozzle is dried to increase viscosity or when paper dust deposits on the nozzle surface where the ink nozzles are arranged.

Therefore, a cleaning device is mounted in the ink-jet printer. A carriage mounting the ink-jet head is regularly moved to the position to oppose the cleaning device which is positioned out of printing range. Then, the cleaning device is used to wipe the nozzle surface and discharge ink of increased viscosity from the ink nozzles.

The typical cleaning device includes a lock lever for locking the ink-jet head carried by the carriage at a cleaning position, a head cap for covering the nozzle surface of the ink-jet head locked at the cleaning position, an ink suction pump for forcedly sucking the ink from respective ink nozzles in the condition where the head cap is fitted, and a wiper blade formed with a rubber plate or the like for wiping the nozzle surface. The wiper blade is moved to a wiping position capable of contacting with the nozzle surface only when the nozzle surface is wiped, so that the wiper blade is prevented from unnecessary wearing. On the other hand, the lock lever and the wiper blade are driven by a driving motor of an ink suction pump from a viewpoint of down-sizing of the device and whereby for obtaining compact ink-jet printer.

As the wiper blade in the cleaning device of the ink-jet printer, one has been proposed in Japanese Unexamined Patent Publication No. Showa 62-251145. In this publication, the wiper blade includes a main blade constructed rotatably and a sub-blade fixed within a region where the main blade moves. The ink or the like deposited on the main blade is wiped by the sub-blade for preventing the deposit on the main blade from being transferred back to the nozzle surface.

It has also been proposed that, from a viewpoint of preventing clogging of the ink nozzles, the ink-jet printer has the ink-jet head whose nozzle surface faces downward. In the ink-jet printer of this type, with respect to the ink-jet head which reciprocates horizontally with the nozzle surface facing downward, the wiper blade is elevated upward from below to wipe the nozzle surface.

However, in the cleaning device which moves the wiper blade up and down, since the ink-jet head passes horizontally above the device, paper dust or the like deposited on the nozzle surface may drop into an opening portion where the wiper blade passes, to deposit on the wiper blade. Deposition of foreign matter, such as paper dust, on the wiper blade is not desirable because it may be deposited again on the nozzle surface during wiping of the nozzle surface.

Therefore, the sub-blade may be placed within the motion path of the wiper blade and wipe it for removing the foreign matter deposited thereon. However, unless the contact condition is appropriately controlled, both blades may wear within a short period. Of course, wearing of the wiper blade can be reduced by shifting the sub-blade. However, since the member for moving the sub-blade has to be provided separately, the number of parts is inherently increased.

Next, in the conventional cleaning device, in view of reduction in number of parts of the device and down-sizing of the printer, the driving motor of the ink suction pump is also used as a driving source of the wiper blade and the lock lever. In general, rotational torque of the driving motor of the ink suction pump is taken out via a friction type power transmission path to deliver to the wiper blade and the lock lever.

When the wiper blade is moved in a condition that it is contacted with the sub-blade, due to a frictional force between the blades, a large driving force is required in comparison with the case where the wiper blade is driven to move without contacting the sub-blade. The conventional driving mechanism is, however, designed to transmit power only by means of frictional force, so that the driving force for the wiper blade tends to lack, and the wiper blade may not be moved. Likewise, if an external force acts on the wiper blade while moving in a certain cause, the wiper blade may be impossible to move.

In order to obtain a reliable movement of the wiper blade, the driving force to be transmitted must be increased. However, since the friction type power transmission path to the wiper blade and the lock lever from the ink suction pump is common, the driving force for moving the lock lever is inevitably increased. If the driving force for moving the lock lever becomes large, the following problem may occur.

Namely, since position control of the ink-jet head is performed precisely, it can be expected that the ink-jet head may be accurately positioned in opposition to the cleaning device. However, when unexpected external force is applied, the ink-jet head may stop at a position offsetting from the position opposing to the cleaning device, namely a locking position by the lock lever. In such cases, when the driving force for moving the lock lever is excessively large, the ink-jet head may be damaged by the lock lever.

On the other hand, the friction type power transmission path for transmitting the driving force to the lock lever and the wiper blade, is constituted by a rotary type friction clutch to which a rotational torque of the driving motor of the ink suction pump is transmitted, and a cam mechanism for converting rotational motion into a reciprocal motion of the wiper blade and the lock lever.

In this case, depending upon rotational amount of the friction clutch, the wiper blade and the lock lever are moved linearly in reverse directions. Namely, when the cleaner lever is moved to a wiping position where it contacts with the nozzle surface, the lock lever is moved to an unlock position, and conversely, when the wiper blade is moved away from the nozzle surface, the lock lever reaches a lock position for locking the ink-jet head.

Since the wiping position of the wiper blade and the lock position of the lock lever are predetermined, strokes of respective levers are determined on the basis of these positions. As a result, the stoke of each lever has to be excessively long in comparison with a case where both levers are moved by separate power transmission paths or driving sources, which is undesirable for down-sizing of the cleaning device.

SUMMARY OF THE INVENTION

An object of the present invention is to provide a cleaning device having a main wiper member for wiping a nozzle surface of an ink-jet head and a sub-wiper member for wiping the main wiper member, which is capable of reducing wearing of these wiper members.

Another object of the present invention is to provide a cleaning device having a main wiper member for wiping a nozzle surface of an ink-jet head and a sub-wiper member for wiping the main wiper member, which can prevent deposition of foreign matter, such as paper dust dropping from the ink-jet head, on the main wiper member.

A further object of the present invention is to provide a cleaning device having a wiper member for wiping a nozzle surface of an ink-jet head, which is able to certainly move the wiper member between a wiping position and a retracted position thereof.

A still further object of the present invention is to provide a cleaning device which converts a rotational torque taken out via a friction clutch from a common rotational driving source into a linear motion of a lock lever for locking an ink-jet head via a cam mechanism and into a linear motion of a cleaner lever mounted on the wiper member for wiping a nozzle surface of the ink-jet head, for restricting strokes of a lock lever and a cleaner lever to be minimum.

A yet further object of the present invention is to provide an ink-jet printer having the novel cleaning device as set forth above.

According to the first aspect of the present invention, a cleaning device for cleaning a nozzle surface of an ink-jet head, comprises:

- a first wiping member for wiping the nozzle surface;
- a cleaner lever for supporting the first wiping member;
- a lever driving mechanism for moving the first wiping member between a retracted position located away from the nozzle surface and a wiping position for wiping the nozzle surface; and
- a flat plate form second wiping member formed of an elastic body arranged within a motion path of the first wiping member so as to contact with the first wiping member.

With the cleaning device according to the present invention, within a limited part of the moving path of the first wiping member between the wiping position and the retracted position, the first wiping member contacts with the second wiping member. This means that the contact period of time between the first and second wiping members is short, and excessive wearing of both wiping members can be prevented.

In the cleaning device according to the present invention, when the first wiping member is designed to move between the retracted position and the wiping position located above the retracted position, it is preferable that the second wiping member is placed at a position above the retracted position and below the wiping position of the first wiping member.

With this constitution, when the first wiping member is retracted, the second wiping member is located above the first wiping member to close the moving path of the first wiping member. Therefore, even when foreign matter, such as paper dust or the like falls down from the ink-jet head passing above the first wiping member, such foreign manner will never deposit on the first wiping member.

The cleaner lever may have a third wiping member which is able to contact with the second wiping member while the cleaner lever is moving. With such constitution, since the foreign matter deposited on the second wiping member is wiped by the third wiping member, the foreign matter deposited on the second wiping member will never transferred to the first wiping member again.

The second wiping member may be supported by a first supporting member at a side surface on the side of the retracted position of the first wiping member and by a second supporting member at a side surface on the side of the wiping position of the first wiping member, wherein a length of a portion of the second wiping member projecting from the first supporting member is shorter than the that of a portion of the second wiping member projecting from the second supporting member.

When the length of the projected portions of the second wiping member is different at both sides, in comparison with the case where it is the same at both sides, it is possible to reduce the frictional force applied on the second wiping member when the first wiping member is moved in a condition that it is contacted with the second wiping member. This can reduce wearing of the second wiping member, permitting a long period of use of the second wiping member.

A tip end surface of the first wiping member may contact with the side surface of the second wiping member. By this, the second wiping member can be certainly contacted with the edge portion of the first wiping member, and at the same time, it can be deflected at the edge portion of the first wiping member. Therefore, the foreign matter deposited on the edge portion of the first wiping member can be uniformly removed.

The lever driving mechanism may includes:

- a rotary driving source;
- a gear train to be driven by the rotary driving source;
- a friction type clutch lever which is frictionally engaged with one of gears constituting the gear train by means of a predetermined biasing force and is arranged coaxially with the gear;
- a first cam mechanism for converting rotation of the clutch lever into movement of the cleaner lever; and
- a tooth portion formed on the clutch lever which engages with the gear train when the clutch lever is within a predetermined rotational angular range.

The thus constituted lever driving mechanism is able to transmit the driving force of the rotary driving source via either one of or both of frictional engagement and mechanical engagement. Therefore, by appropriately setting the range to transmit the driving force through mechanical engagement, even when external force act on the cleaner lever, reliable movement thereof can be assured.

The tooth portion may come into engagement with the gear train when the first wiping member is being moved in a condition contacting with the second wiping member.

When the first and second wiping members become contacted with each other, the cleaner lever supporting the first wiping member bears large resistance from the second wiping member. This may cause to deteriorate steady movement of the cleaner lever driven by frictional transmission of the driving force. However, in the present invention, where the first and second wiping members are in contact, driving force is also transmitted via mechanical engagement to the cleaner lever. Therefore, even when resistance from the second wiping member is applied, the cleaner lever can be moved steadily.

The first cam mechanism may include a first cam follower formed in the cleaner lever, a first cam surface contacting with the first cam follower while the cleaner lever moves to the wiping position, and a second cam surface contacting with the first cam follower while the cleaner lever moves to the retracted position, wherein the first and second cam surfaces are arranged at a predetermined angle with respect to each other.

Since the cleaner lever is moved with the cam surfaces having different angles, the cleaner lever can be certainly moved to the desired direction.

The cleaning device may further comprise a lock lever for locking the ink-jet head at a predetermined position, wherein the lever driving mechanism includes a second cam mechanism for converting a rotational force of the rotary driving source into a driving force for moving the lock lever between a locking position for fixing the ink-jet head and an unlocking position away from the ink-jet head.

In this case, it is desirable that the first cam mechanism includes a first cam follower formed in the cleaner lever, the first cam follower following a first cam region for reciprocally moving the cleaner lever between the wiping position and the retracted position according to rotation of the clutch lever, and a second cam region for holding the cleaner lever at the retracted position even when the clutch lever is rotated. It is also desirable that the second cam mechanism includes a second cam follower formed in the lock lever, the second cam follower following a third cam region for reciprocally moving the lock lever between the locking position and the unlocking position according to rotation of the clutch lever and a fourth cam region for holding the lock lever at the unlocking position even when the clutch lever is rotated.

With this constitution, since the cleaner lever and the lock lever can be moved only by a necessary amount of distance, the stoke can be necessary minimum value, to contribute to down-sizing of the device.

Particularly, it is preferred that while the first cam follower is operated in the first cam region, the second cam follower is operated in the fourth cam region, and when the first cam follower is shifted in operation into the second cam region, the second cam follower is shifted into operation in the third cam region.

In the typical constitution, the second cam region is defined by an arc shaped cam groove centered at a rotational center of the clutch lever, and the fourth cam region is also defined by an arc shaped groove centered at the rotational center of the clutch lever.

On the other hand, the cleaning device may further comprise an ink pump device for sucking ink from ink nozzles of the ink-jet head, wherein the rotary driving source is a motor for driving the ink pump device.

Next, according to the present invention, there is provided a cleaning device for cleaning a nozzle surface of an ink-jet head, which comprises:

- a first wiping member for wiping the nozzle surface;
- a cleaner lever for supporting the first wiping member; and
- a lever driving mechanism moving the first wiping member between a retracted position located away from the nozzle surface and a wiping position for wiping the nozzle surface; wherein the lever driving mechanism includes:
  - a rotary driving source;
  - a gear train to be driven by said rotary driving source;
  - a friction type clutch lever which is frictionally engaged with one of gears constituting the gear train by means of a predetermined biasing force and is arranged coaxially with the gear;
  - cam mechanism for converting rotation of the clutch lever into movement of the cleaner lever; and
  - a tooth portion formed on said clutch lever which engages with the gear train when the clutch lever is in a predetermined rotational angular range.

It is preferable that the cam mechanism includes a first cam follower formed in the cleaner lever, a first cam surface contacting with the first cam follower while the cleaner lever moves to said wiping position, and a second cam surface contacting with the first cam follower while the cleaner lever moves to the retracted position, and wherein the first and second cam surfaces are arranged at a predetermined angle with respect to each other.

It is also preferable that the cam mechanism includes a cam follower formed in the cleaner lever, the cam follower following a first cam region for reciprocally moving the cleaner lever between the wiping position and the retracted position according to rotation of said clutch lever, and a second cam region for holding the cleaner lever at the retracted position even when the clutch lever is rotated.

The second cam region can be defined by an arc shaped cam groove centered at a rotational center of the clutch lever.

Next, according to the present invention, there is provided a cleaning device for cleaning a nozzle surface of an ink-jet head, which comprises:

- a lock lever for locking said ink-jet head at a predetermined position; and,
- a lever driving mechanism for moving the lock lever between a locking position for fixing the ink-jet head and an unlocking position away from the ink-jet head, wherein
  - the lever driving mechanism includes:
    - a rotary driving source;
    - a gear train to be driven by said rotary driving source;
    - a friction type clutch lever which is frictionally engaged with one of gears constituting said gear train by means of a predetermined biasing force and is arranged coaxially with the gear;
    - cam mechanism for converting rotation of the clutch lever into movement of the lock lever; and
    - a tooth portion formed on said clutch lever which engages with the gear train when the clutch lever is in a predetermined rotational angular range.

Here, it is preferable for the cam mechanism to have a cam follower formed in the lock lever, the cam follower following a third cam region for reciprocally moving the lock lever between the locking position and the unlocking position according to rotation of the clutch lever and a fourth cam region for holding the lock lever at the unlocking position even when the clutch lever is rotated.

The fourth cam region can be defined by an arc shaped groove centered at rotational center of the clutch lever.

While, according to the present invention, there is provided a cleaning device for cleaning a nozzle surface of an ink-jet head, which comprises:

- a first wiping member for wiping the nozzle surface;
- a cleaner lever for supporting the first wiping member;
- a lock lever for locking the ink-jet head at a predetermined position; and
- a lever driving mechanism which moves the first wiping member between a retracted position located away from the nozzle surface and a wiping position for wiping the nozzle surface, and moves the lock lever between a locking position for fixing the ink-jet head and an unlocking position away from the ink-jet head, wherein
  - the lever driving mechanism includes:
    - a rotary driving source;
    - a gear train to be driven by said rotary driving source;
    - a friction type clutch lever which is frictionally engaged with one of gears constituting the gear train by means of a predetermined biasing force and is arranged coaxially with the gear;

a first cam mechanism for converting rotation of the clutch lever into movement of the cleaner lever; and a second cam mechanism for converting rotation of the clutch lever into movement of the lock lever.

It is preferable for the first cam mechanism to include a first cam follower formed in the cleaner lever, the first cam follower following a first cam region for reciprocally moving the cleaner lever between the wiping position and the retracted position according to rotation of the clutch lever, and a second cam region for holding the cleaner lever at the retracted position even when the clutch lever is rotated. Likewise, the second cam mechanism preferably includes a second cam follower formed in the lock lever, the second cam follower following a third cam region for reciprocally moving the lock lever between the locking position and the unlocking position according to rotation of the clutch lever and a fourth cam region for holding the lock lever at the unlocking position even when the clutch lever is rotated.

It is also preferable that, while the first cam follower is operated in the first cam region, the second cam follower is in the fourth cam region, and when the first cam follower is moved into the second cam region, the second cam follower is shifted into operation in the third cam region.

According to the second aspect of the invention, an ink-jet printer is provided, which comprises:

an ink-jet head;

a cleaning device which is arranged offsetting from a printing region of the ink-jet head and is constructed as set forth above; and a carriage carrying the ink-jet head for reciprocally moving along a moving path passing through the printing region and a position opposing to the cleaning device.

By the ink-jet printer according to the present invention, since cleaning of the nozzle surface of the ink-jet head can be certainly performed by the cleaning device, printing can be realized without degradation of printing quality due to clogging of nozzles or the like. In addition, since the cleaning device can be installed in relatively narrow space, down-sizing of the ink-jet printer can also be realized.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of a cleaning device and an ink-jet printer according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

An overall structure of an ink-jet printer is similar to the conventionally known serial type ink-jet printer, and therefore in this disclosure, illustration and disclosure thereof is eliminated. Hereinafter, only a cleaning device and a carriage mounting an ink-jet head will be illustrated and disclosed.

Figure 1:
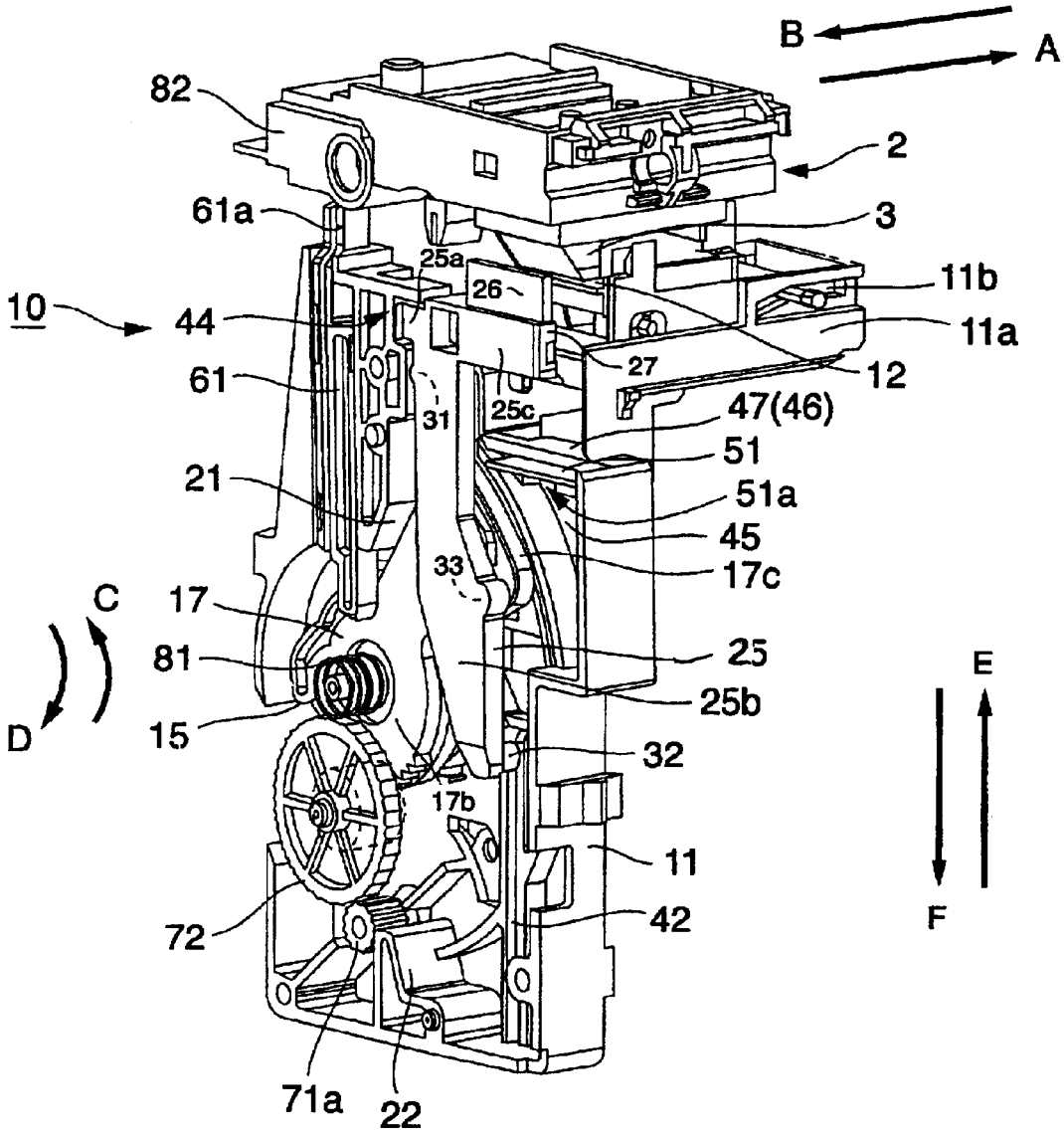
FIG. 1 is a perspective view showing a cleaning device and an ink-jet head in an ink-jet printer having the cleaning device, to which the present invention is applied.
Figure 2:
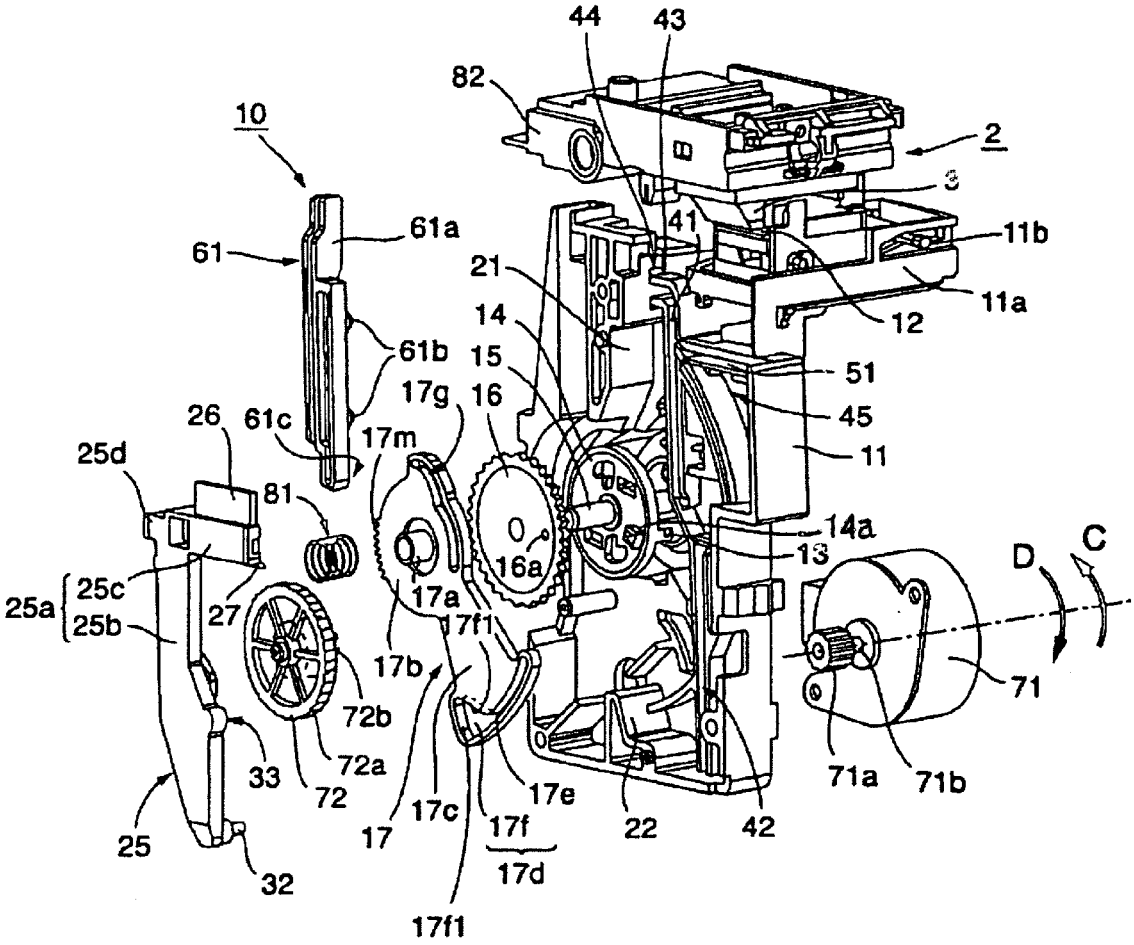
FIG. 2 is an exploded perspective view showing the major portion of the cleaning device of FIG. 1.

FIG. 1 is a perspective view showing a cleaning device and an ink-jet head in an ink-jet printer having a cleaning device, to which the present invention is applied, and FIG. 2 is an exploded perspective view showing the major portion of the cleaning device of FIG. 1.

At first, with reference to FIGS. 1 and 2, the overall structure of the ink-jet head 2 and the cleaning device 10 in the shown embodiment of the ink-jet printer will be discussed. The ink-jet head 2 is mounted on a carriage 82 in a condition that a nozzle surface 3 faces downward. The carriage 82 carrying the ink-jet head 2 can be moved reciprocally along a horizontal direction as indicated by arrows A and B in FIG. 1.

The cleaning device 10 is arranged at a position out of a printing region by the ink-jet head 2. The cleaning device 10 includes a head cap 12, an elastic main blade 26 as a first wiping member for wiping the nozzle surface 3 of the ink-jet head 2, an elastic sub-blade 51 as a second wiping member for wiping the elastic wiping blade 26, a pump unit 14 for sucking ink from ink nozzles (not shown) arranged on the nozzle surface 3 of the ink-jet head 2, and a lock lever 61 for locking the carriage 82 mounting the ink-jet head 2 at a position (cleaning position) shown in FIGS. 1 and 2.

As the ink-jet head 2 approaches the cleaning position as shown in FIGS. 1 and 2, the head cap 12 is moved upward guided by a cam groove 11*b* formed in the housing 11, to fit on the nozzle surface 3. After positioning the ink-jet head 2 at the cleaning position and fitting the head cap 12 on the nozzle surface 3, the lock lever 61 is moved upward to lock the carriage 82. At this locked condition, the pump unit 14 is driven, so that ink can be sucked and discharged from the ink nozzles arranged on the nozzle surface 3. On the other hand, by placing the lock lever 61 at an unlocking position, the elastic wiping blade 26 as the first wiping member is moved at a height to contact with the nozzle surface 3. At this condition, the ink-jet head 2 is reciprocally moved to allow the elastic wiping blade 26 to wipe foreign matter, such as paper dust or the like, deposited on the nozzle surface 3. While, the elastic sub-blade is located horizontally on the moving path of the elastic wiping blade 26, which contacts with the elastic wiping blade 26 passing therethrough and wipes the foreign matter deposited on the elastic wiping blade 26.

Figure 3:
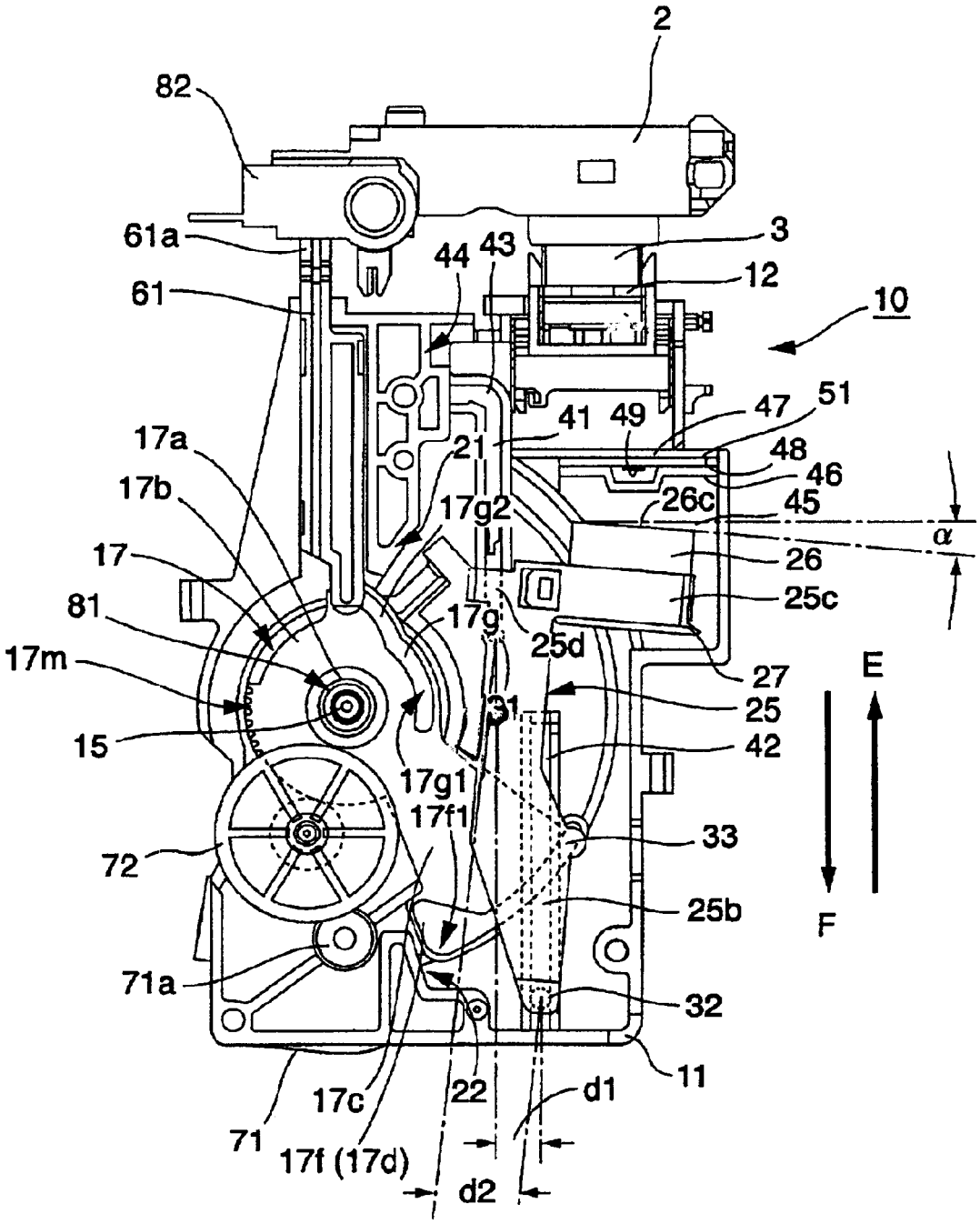
FIG. 3 is a general front elevation of the cleaning device and the ink-jet head illustrated in a position where an elastic blade is in a retracted position.
Figure 4:
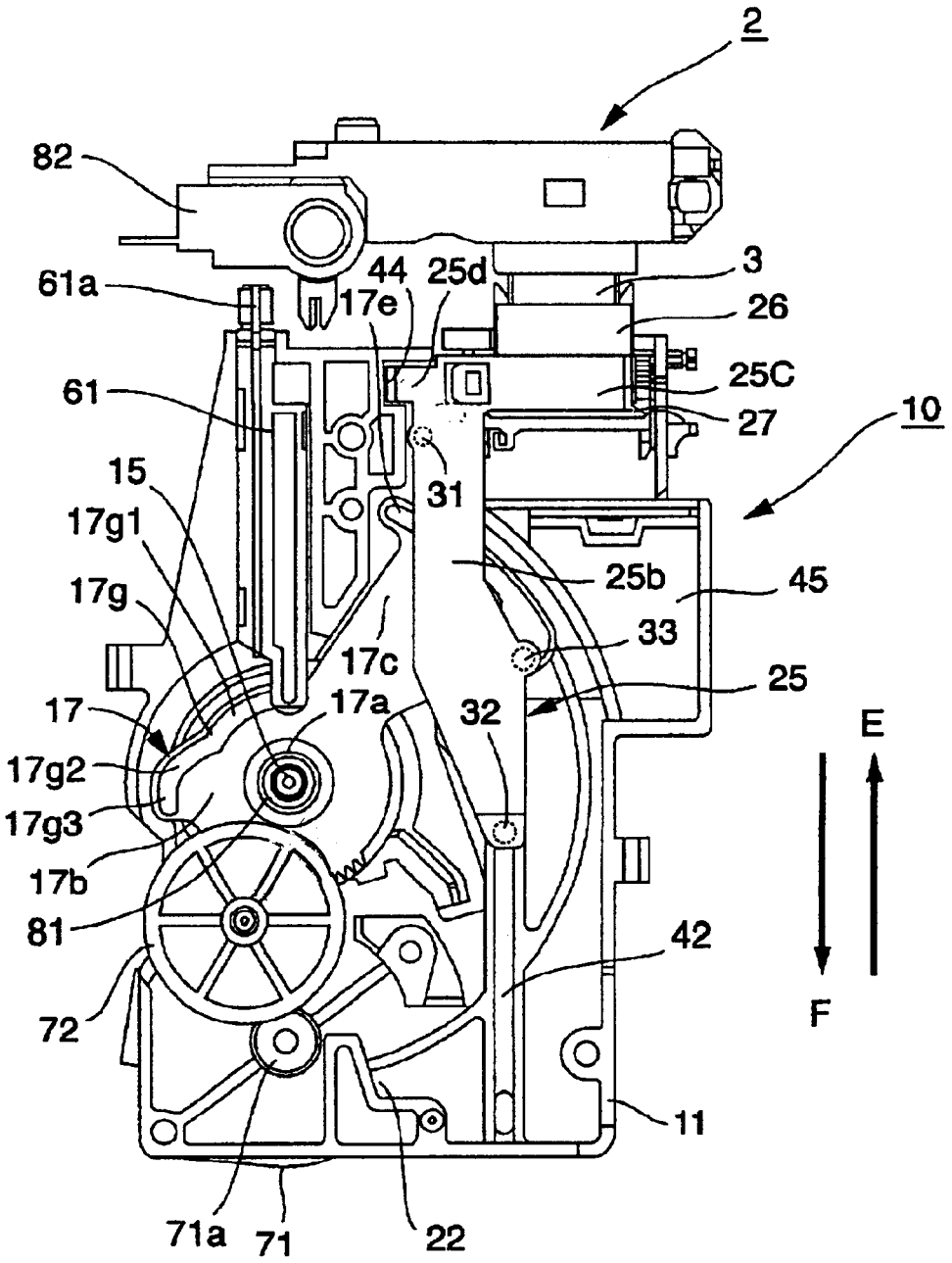
FIG. 4 is a general front elevation of the cleaning device and the ink-jet head illustrated in a position where an elastic blade is in a wiping position.
Figure 5A:
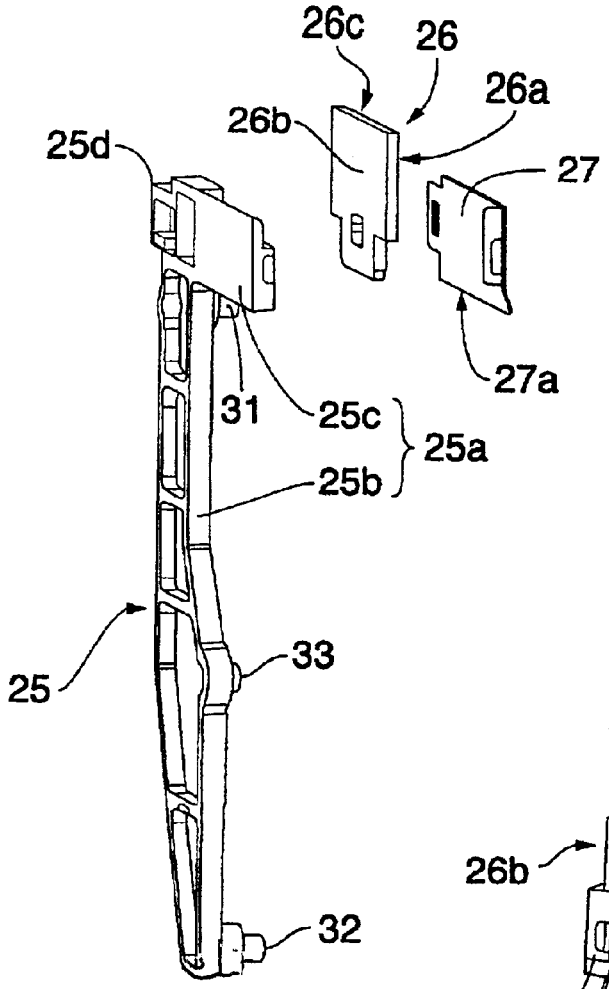
FIGS. 5A and 5B are perspective views showing a cleaner lever and the elastic blade mounted in the cleaning device of FIG. 1.
Figure 5B:
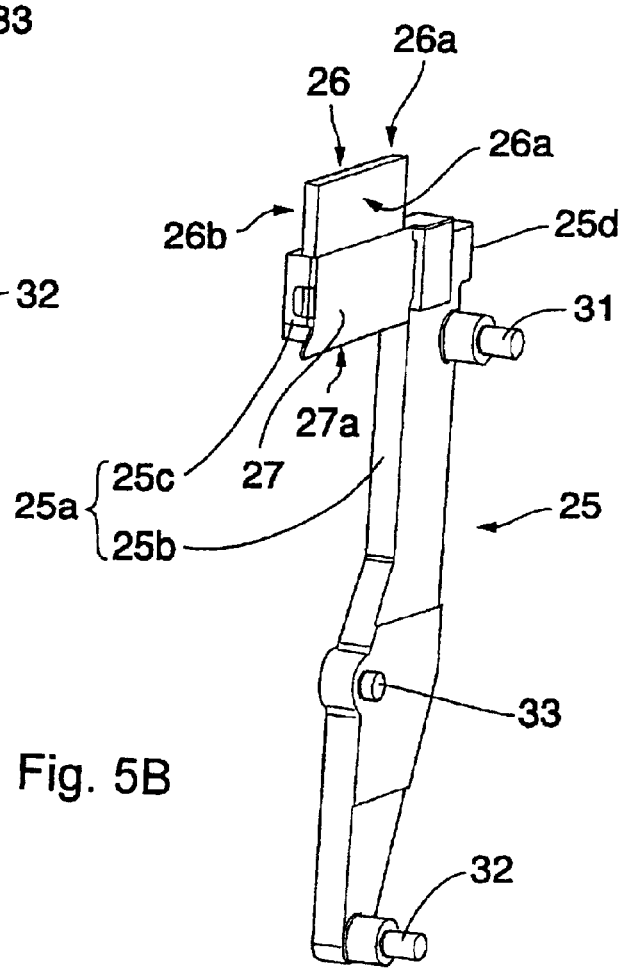
Figure 6A:
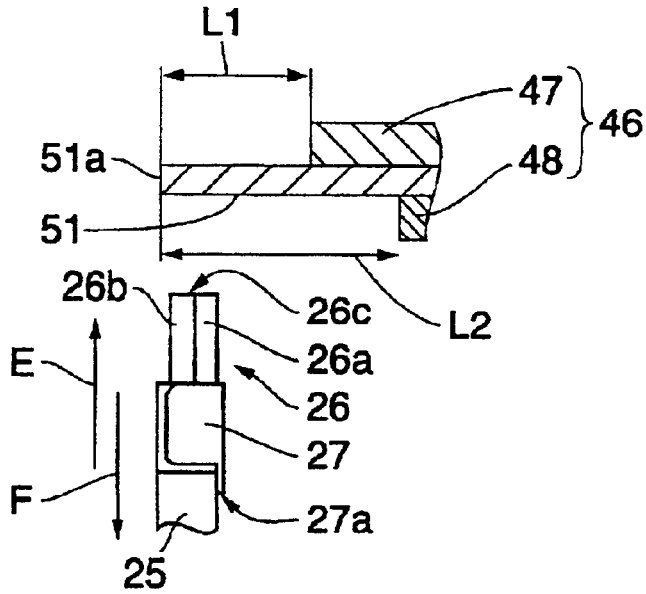
FIGS. 6A, 6B and 6C are an explanatory illustrations showing wiping operation of a sub-blade in the cleaning device of FIG. 1.
Figure 6B:
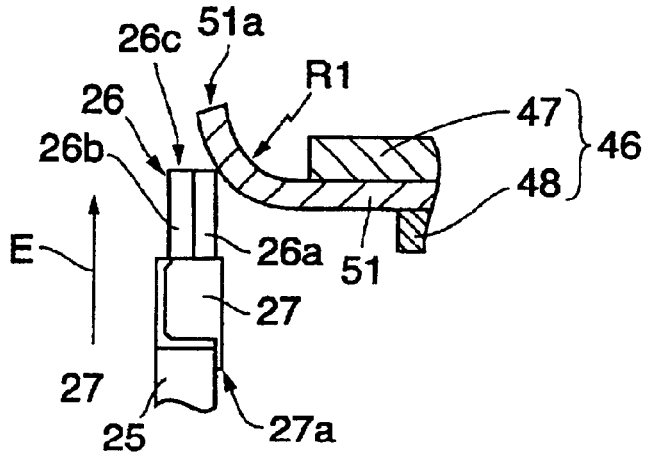
Figure 6C:
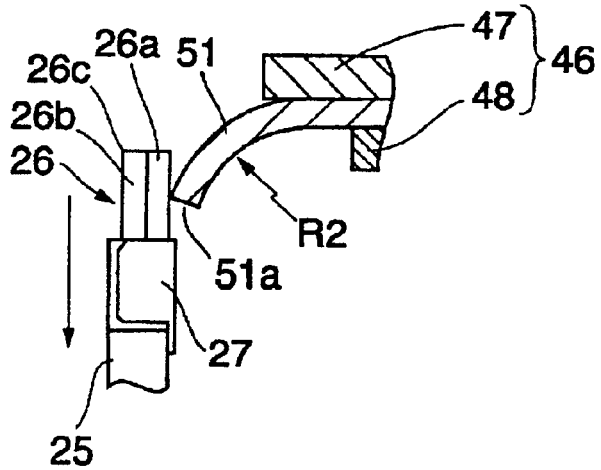

FIGS. 3 and 4 are general front elevations of the cleaning device and the ink-jet head, in which FIG. 3 shows the elastic wiping blade 26 in its retracted position and FIG. 4 shows the elastic wiping blade 26 in its wiping position for wiping the nozzle surface 3. FIGS. 5A and 5B are a perspective view showing a cleaner lever, on which the elastic wiping blade 26 is mounted, and FIGS. 6A, 6B and 6C are a partial side elevation showing a relationship of position between the elastic wiping blade and the elastic sub-blade.

Referring to FIGS. 1 to 6C, the detailed structure of the shown embodiment of the cleaning device 10 will be discussed. The shown embodiment of the cleaning device 10 has a housing 11 of compressed box shape and formed of a synthetic resin or the like. The housing 11 is mounted vertically on a device frame (not shown) of the ink-jet printer 1. From the upper end portion of the housing 11, a horizontal frame portion 11*a* is projected toward the back surface side of the housing. On the horizontal frame portion 11*a*, a box shaped head cap 12 is mounted in a condition facing upward and movable between an upper position for covering the nozzle surface 3 and a lower retracted position.

At the vertically intermediate position of the housing 11, a circular concave portion 13 projecting backward is formed, in which a generally cylindrical pump unit 14 (ink suction pump) is accommodated. A driving support shaft 15 of the pump unit 14 is rotatable in forward and reverse directions as shown by arrows C and D (see FIG. 2).

On the lower side position of the pump unit 14, a driving motor 71 (rotary driving source) is mounted on the housing 11, whose output shaft 71*b* projects in parallel to the driving support shaft 15 and is fixedly provided on its tip end with a pinion gear 71*a*. A stepped gear 72 is also mounted rotatably on the housing 11, which is formed with a large diameter gear 72*a* and a small diameter gear 72*b*, these gears being formed coaxially. The large diameter gear 72*a* is meshed with a pinion gear 71*a*, while the small diameter gear 72*b* is meshed with a pump gear 16 which is coaxially mounted on the driving support shaft 15 of the pump unit 14. Accordingly, a rotational torque of the driving motor 71 is transmitted to the pump gear 16 via the pinion gear 71*a* and stepped gear 72.

The pump unit 14 is formed with engaging portions 14*a* on the ring shaped end surface. In opposition, an engaging portion 16*a* is formed on the side surface of the pump gear 16. Accordingly, after the pump gear 16 is rotated to engage its engaging portion 16*a* with the engaging portion 14*a* of the pump unit 14, it drives to rotate the pump unit 14.

(Clutch Lever)

Next, on the driving support shaft 15 of the pump unit 14, a friction engagement type clutch lever 17 is pivotably mounted in the condition superposed on the surface side of the pump gear 16. The clutch lever 17 has a clutch portion 17*b* having a substantially disk shape of the substantially same size as the pump gear 16, and a fan-shaped lever portion 17*c* formed integrally on and extending radially from the clutch portion 17*b*.

The clutch portion 17*b* of the clutch lever 17 is biased by a compression coil spring 81 toward the side surface of the pump gear 16, so that it is rotated by and together with the pump gear 16 unless slip is occurred between its frictional surface and the corresponding frictional surface of the pump gear 16. Thus, the clutch lever 17 is driven by the driving motor 71 via a gear train comprised by the pinion gear 71*a*, stepped gear 72 and pump gear 16, and via frictional engagement between it and the pump gear 16

As can be seen from FIGS. 2 and 3, on the outer peripheral end surface of the clutch portion 17*b* of the clutch lever 17, a tooth portion 17*m* (meshing portion) engageable with the small gear 72*b* of the stepped gear 72, is formed over a predetermined angular range. Over the predetermined rotational angular range of the clutch lever 17, the tooth portion 17*m* is held in meshed condition with the small gear 72*b*. In this meshed condition, the clutch lever 17 is driven by the driving motor 71 via meshing engagement of the tooth portion 17*m* and the stepped gear 72, as well as via the frictional engagement.

It should be noted that as can be seen from FIGS. 1 to 3, on the upper end portion and the lower end portion of the housing 11, a first engaging portion 21 and a second engaging portion 22 defining upper and lower pivoting ends of the lever portion 17*c* of the clutch lever 17 is formed.

(Elastic Wiping Blade and Elastic Sub-blade)

Next, a cleaner lever 25, on a tip end of which the elastic wiping blade 26 is mounted, is placed on the surface side of the lever portion 17*c* of the clutch lever 17 and is partly overlapped with the lever portion 17*c*. As shown in FIGS. 5A and 5B, the cleaner lever 25 has a main body portion 25*a* formed of synthetic resin into substantially L-shaped flat plate form, for example. The main body portion 25*a* includes a lever portion 25*b* extending in a longitudinal direction and an arm portion 25*c* formed to extend substantially perpendicular to the lever portion 25*b*.

On the arm portion 25*c* of the cleaner lever 25, the elastic wiping blade 26 (first wiping member) is mounted. The elastic wiping blade 26 is an essentially rectangular plate formed by laminating a rubber material 26*a* of a predetermined thickness (for example, about 0.8 mm) and a felt material 26*b* of a predetermined thickness (for example, about 0.7 mm). A tip end face of the elastic wiping blade 26 serves as a first blade portion. The rubber material 26*a* has a wiping function for wiping off the ink or the like on the nozzle surface 3, and the felt material 26*b* has a rubbing function for wiping to absorb the ink or the like on the nozzle surface 3.

The lower end edge portion of the elastic blade 26 is mounted on the arm portion 25*c* in a condition overlapping with the arm portion 25*c* of the cleaner lever 25 with a predetermined width. The overlapping portion is covered with a metal blade 27 (third wiping member). The metal blade 27 is a thin plate slightly greater than the arm portion 25*c* of the cleaner lever 25 and is arranged to be tightly fitted to the rubber material 26*a* of the elastic wiping blade 26.

The lower end edge of the metal blade 27 is slightly extended from the lower end edge of the arm portion 25*c* of the cleaner lever 25. The extended portion serves as the third blade portion 27*a*. The third blade portion 27*a* is parallel to the first blade portion 26*c* of the elastic wiping blade 26.

The thus constituted cleaner lever 25 is movable vertically along first and second guide grooves 41 and 42 formed in the housing 11. The first guide groove 41 extends vertically from the intermediate position of the housing 11 to the upper portion of the housing 11. In the upper end portion of the guide groove 41, a corner groove 43 extending horizontally to the first engaging portion 21, is continuously formed.

The second guide groove 42 is formed on the lower side of the first guide groove 41 and extends vertically from the intermediate position of the housing 11 to the lower portion of the housing 11. These first and second guide grooves 41 and 42 are arranged in parallel with a given distance d1.

The cleaner lever 25 is formed at the end portion on the side of the arm portion 25*a* and at the other end portion of the lever portion 25*b*, with a first supporting projection 31 slidable along the first guide groove 41 and the corner groove 43, and a second supporting projection 32 slidable along the second guide groove 42. The cleaner lever 25 in a condition that the first supporting projection 31 and the second supporting projection 32 are inserted into the first and second guide grooves 41 and 42, is movable vertically along the guide grooves 41 and 42 while maintaining its orientation vertically. The lowermost position of the cleaner lever 25 corresponds to the retracted position, and its uppermost position is the wiping position, at which the nozzle surface 3 can be wiped.

Here, as shown in FIGS. 1 and 4, in the condition where the first supporting projection 31 of the cleaner lever 25 is inserted in the corner groove 43, the elastic wiping blade 26 is projected upward from the head cap 12 of the housing 11, and the first blade portion 26*c* is positioned upper side of the nozzle surface 3 of the ink-jet head 2. When the first supporting projection 31 goes into the corner groove 43, the upper end portion of the cleaner lever 25 moves horizontally. The projecting portion 25*d* located on extension of the arm portion 25*c* and extending from the lever portion 25*b* is laterally engaged with an engaging groove 44 provided at the upper portion of the corner groove 42.

As shown in FIG. 3, a distance d1 between the first guide groove 41 and the second guide groove 42 in the horizontal direction is set to be narrower than the distance d2 between the first supporting projection 31 and the second supporting projection 32 of the cleaner lever 25 in the direction perpendicular to the arm portion 25*d* extends. By this, the elastic wiping blade 26 of the cleaner lever 25 is supported in the condition that the first blade portion 26*c* is tilted by a small angle $\alpha$ (e.g. 5°) with respect to the horizontal direction.

On the other hand, a blade receptacle portion 45 where the elastic wiping blade 26 is retracted, is formed at the side position of the first guide groove 41 in the housing 11 and the lower position of the head cap 12. The blade receptacle portion 45 is formed into substantially box shape and the upper surface side thereof is formed with an opening portion for permitting the elastic wiping blade 26 to pass through.

The elastic sub-blade 51 (second wiping member) is supported by a blade supporting portion 46 (supporting member) so as to close the opening portion of the receptacle portion 45 (in other words, in a condition blocking the moving path of the elastic wiping blade 26). The elastic sub-blade 51 is formed into substantially rectangular configuration of rubber material. The length of the second blade portion 51*a* formed on the end edge in the longitudinal direction is set to be greater than the length of the first blade portion 26*c* of the elastic wiping blade 26.

The blade supporting portion 46 has the second supporting member 47 and the first supporting member 48. These supporting members 47 and 48 are arranged in parallel with a distance slightly greater than the thickness of the elastic sub-blade 51. Between the supporting members 47 and 48, a slit is defined for the elastic sub-blade 51 to insert. The elastic sub-blade 51 is attached to the blade supporting portion 46 by engaging it with a claw portion 49 provided on the inner side of the slit.

As shown in FIG. 6A, the elastic sub-blade 51 is projected for a length L1 (for example, about 5 mm) from the tip end of the second supporting member 47 on its upper surface, whereas it is projected for a length L2 (for example, about 7 mm) from the first supporting member 48 on its lower side.

(Lock Lever)

On the upper portion of the housing 11, a lock lever 61 is arranged at a position adjacent to the cleaner lever 25. The lock lever 61 is a bar shaped body and is formed at its tip end portion with an engaging portion 61*a* engageable with the carriage 82 mounting the ink-jet head 2.

The housing 11 is also provided with a third guide groove (not shown) for guiding the lock lever 61 in the vertical direction. The lock lever 61 is guided by the third guide groove to move up and down in a condition that an engaging projection 61*b* formed at the intermediate portion thereof slides along the third guide groove.

(Cam Mechanism and Tooth Portion for Driving Clutch Lever and Lock Lever)

At first, discussion will be given for a first cam mechanism for converting rotating motion of the clutch lever 17 into reciprocating motion of the cleaner lever 25. On the outer peripheral portion of the lever portion 17*c* of the clutch lever 17, a first cam groove 17*d* as a component of the first cam mechanism for moving the cleaner lever 25 vertically, is formed. The first cam groove 17*d* is constituted by a first arc shaped cam groove 17*e* formed to have a predetermined center angle at the same radius about a support shaft portion 17*a* of the clutch portion 17*b* and a triangular cam groove 17*f* formed to extent in a substantially triangular region on the side of the support shaft portion 17*a* from the first arc shaped cam groove 17*e*. The triangular cam 17*f* is provided with a first cam surface 17*f*1 for moving the cleaner lever 25 having the elastic wiping blade 26 up to the wiping position, and a second cam surface 17*f*2 for moving the cleaner lever 25 away from the nozzle surface 3. The first cam surface 17*f*1 and the second cam surface 17*f*2 form a predetermined angle. On the other hand, at the intermediate portion of the lever portion 25*b* of the cleaner lever 25, a first cam follower 33 is formed which is insertable into and slidable along the first cam groove 17*d*.

Next, discussion will be given for the second cam mechanism for converting the rotational motion of the clutch lever 17 into the up and down motion of the lock lever 61. On the outer peripheral portion of the clutch portion 17*b* of the clutch lever 17, a second cam groove 17*g* is formed. The second cam groove 17*g* is constituted by a second arc shaped cam groove 17*g*1, an actuation cam groove 17*g*2 and an engaging groove 17*g*3.

The second arc shaped cam groove 17g1 is arranged to have a predetermined center angle at the same radius about the support shaft portion 17a of the clutch portion 17b. On the other hand, the actuation cam groove 17g2 is formed with a range of the predetermined center angle to have gradually increasing radius from one end in the second arc shaped cam groove 17g1. The amount of increase in radius of the actuation cam groove 17d2 corresponds to a stroke length L1 of the engaging portion 61a of the lock lever 61 (see FIG. 8, to be discussed later). Furthermore, the engaging groove 17g3 is formed to extent from the end portion of the actuation cam groove 17g2 along a direction substantially perpendicular to the radial direction of the cam groove 17g2. On the other hand, on the lower portion of the lock lever 61, a second cam follower 61c is formed which is inserted in the second cam groove 17g and is slidable therealong.

Here, a relationship in position of the clutch lever 17, the cleaner lever 25 and the lock lever 61 will be discussed with reference to FIGS. 7 to 12.

Figure 7:
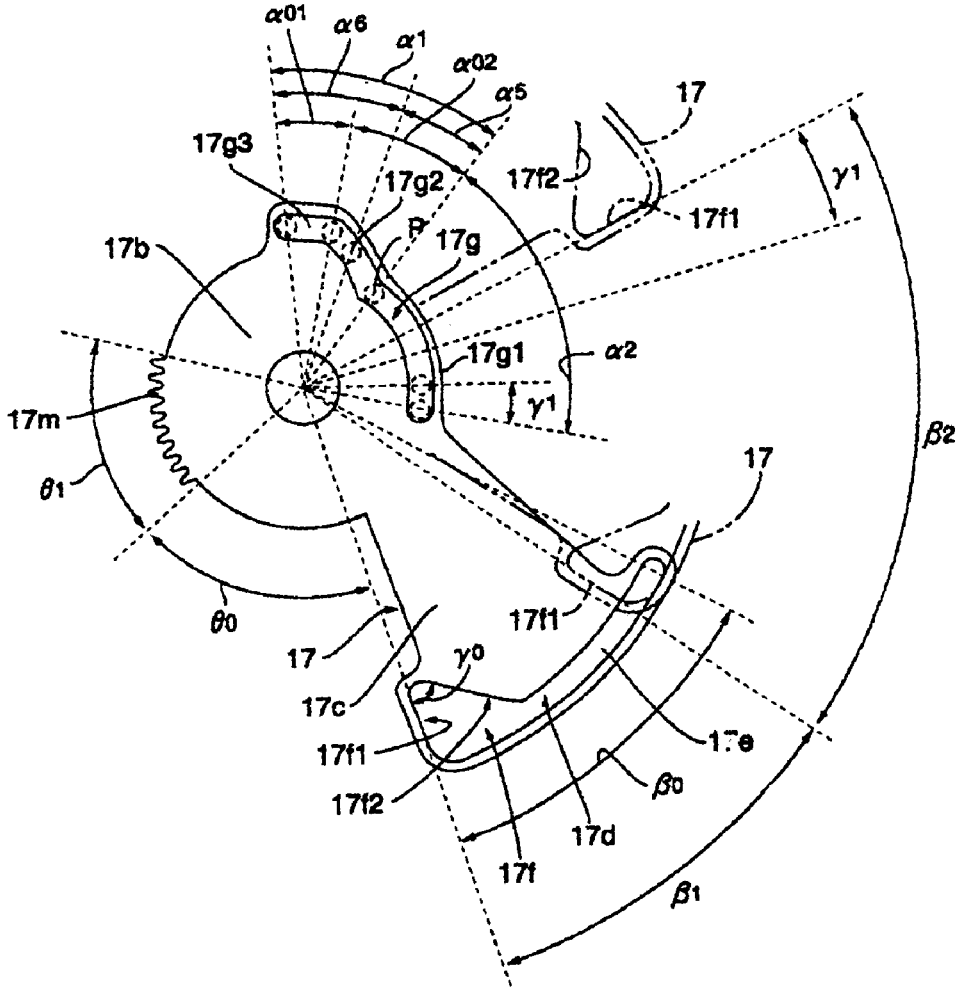
FIG. 7 is an illustration showing positional relationship between a first cam mechanism, a second cam mechanism and a tooth portion of a clutch lever of the cleaning device of FIG. 1.
Figure 8:
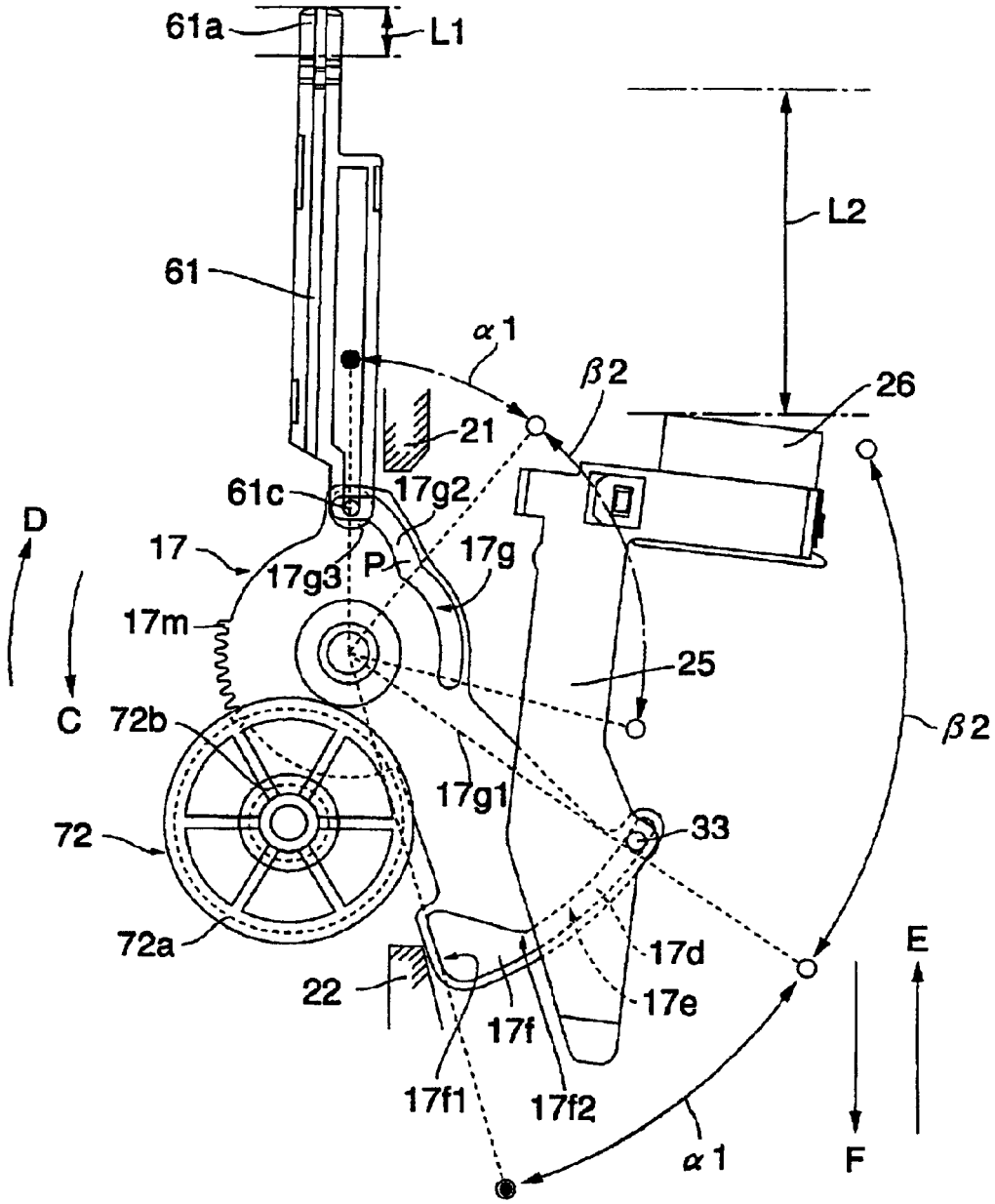
FIG. 8 is an illustration showing positional relationship between a first cam mechanism, a second cam mechanism and a tooth portion of a clutch lever of the cleaning device of FIG. 1, illustrated in a position where only cleaner lever is placed in a retracted position.
Figure 9:
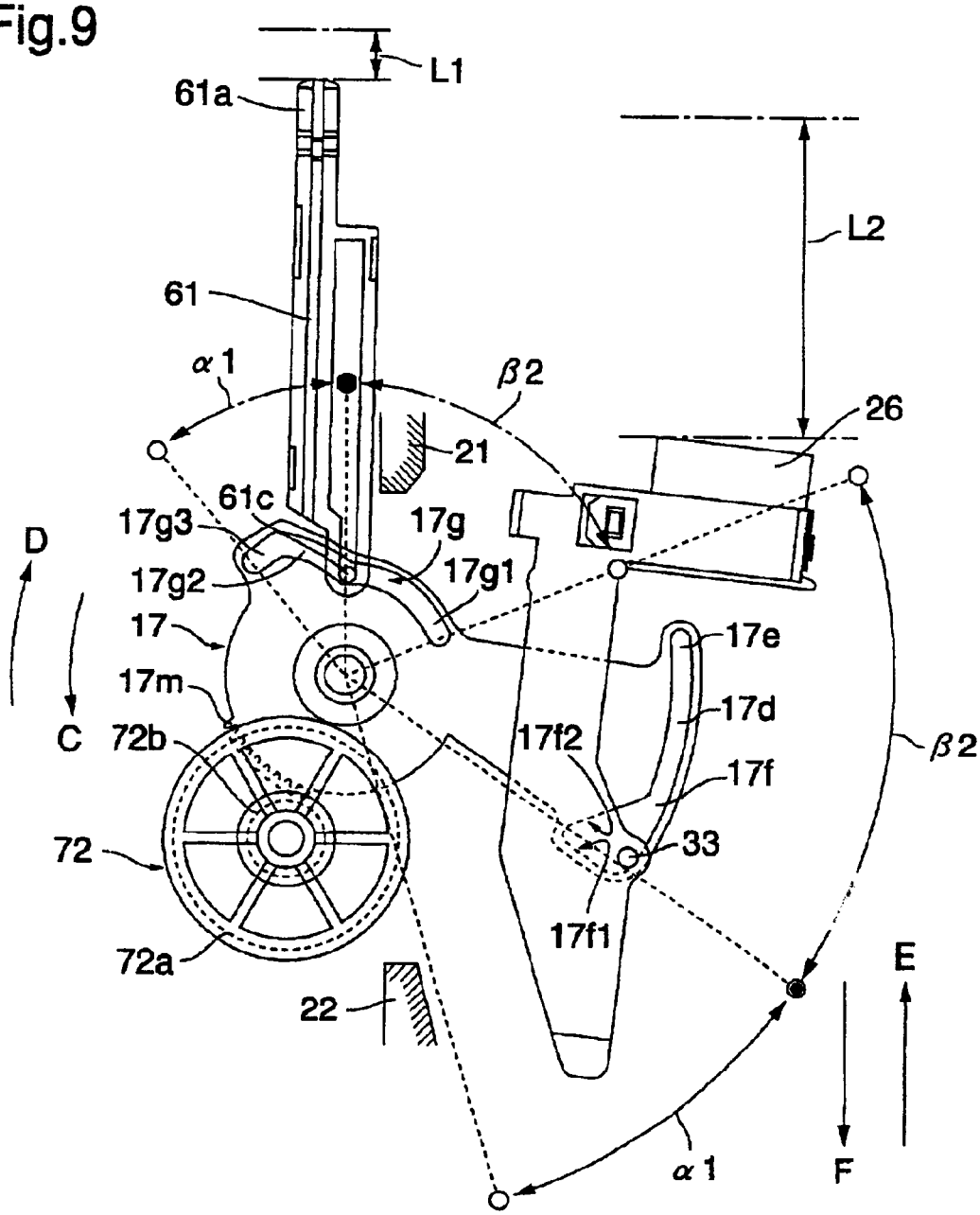
FIG. 9 is an illustration showing positional relationship between a first cam mechanism, a second cam mechanism and a tooth portion of a clutch lever of the cleaning device of FIG. 1, illustrated in a position where the cleaner lever and the lock is placed in their retracted positions.
Figure 10:
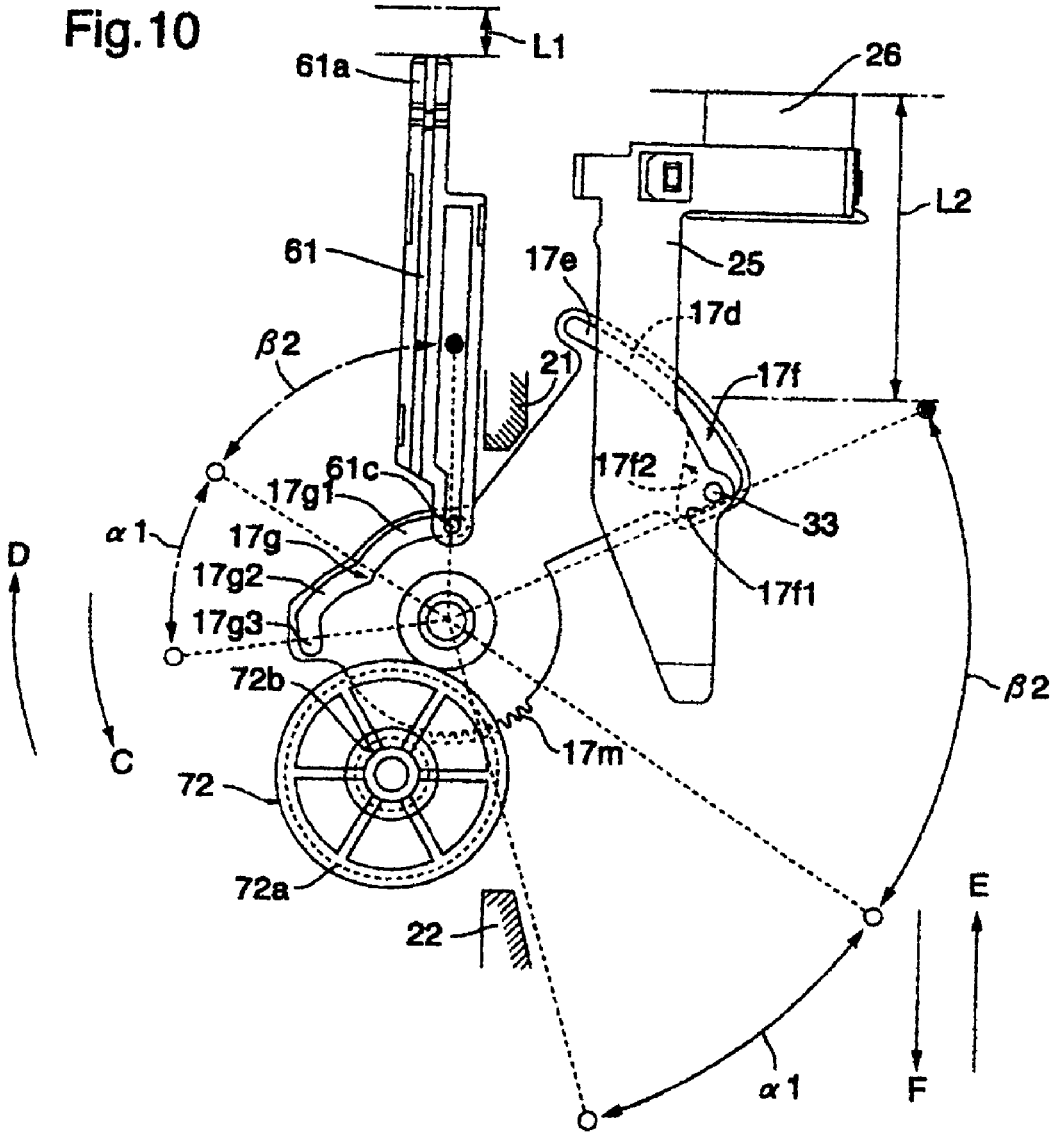
FIG. 10 is n illustration showing positional relationship between a first cam mechanism, a second cam mechanism and a tooth portion of a clutch lever of the cleaning device of FIG. 1, illustrated in a position where only the lock lever is placed in its retracted position.
Figure 11:
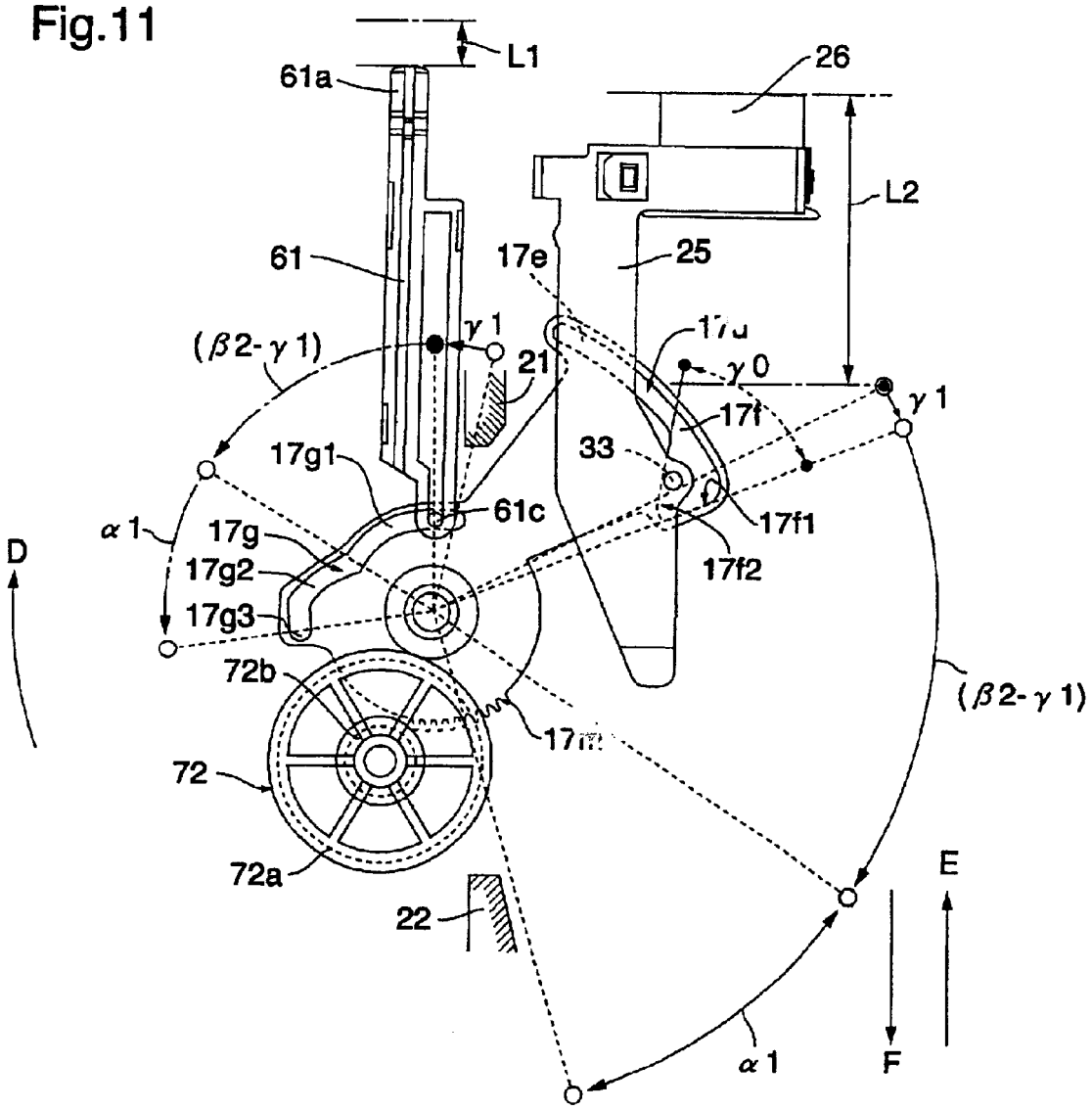
FIG. 11 is an illustration showing positional relationship between a first cam mechanism, a second cam mechanism and a tooth portion of a clutch lever of the cleaning device of FIG. 1, illustrated in a position where only the cleaner lever is placed in its wiping position.
Figure 12:
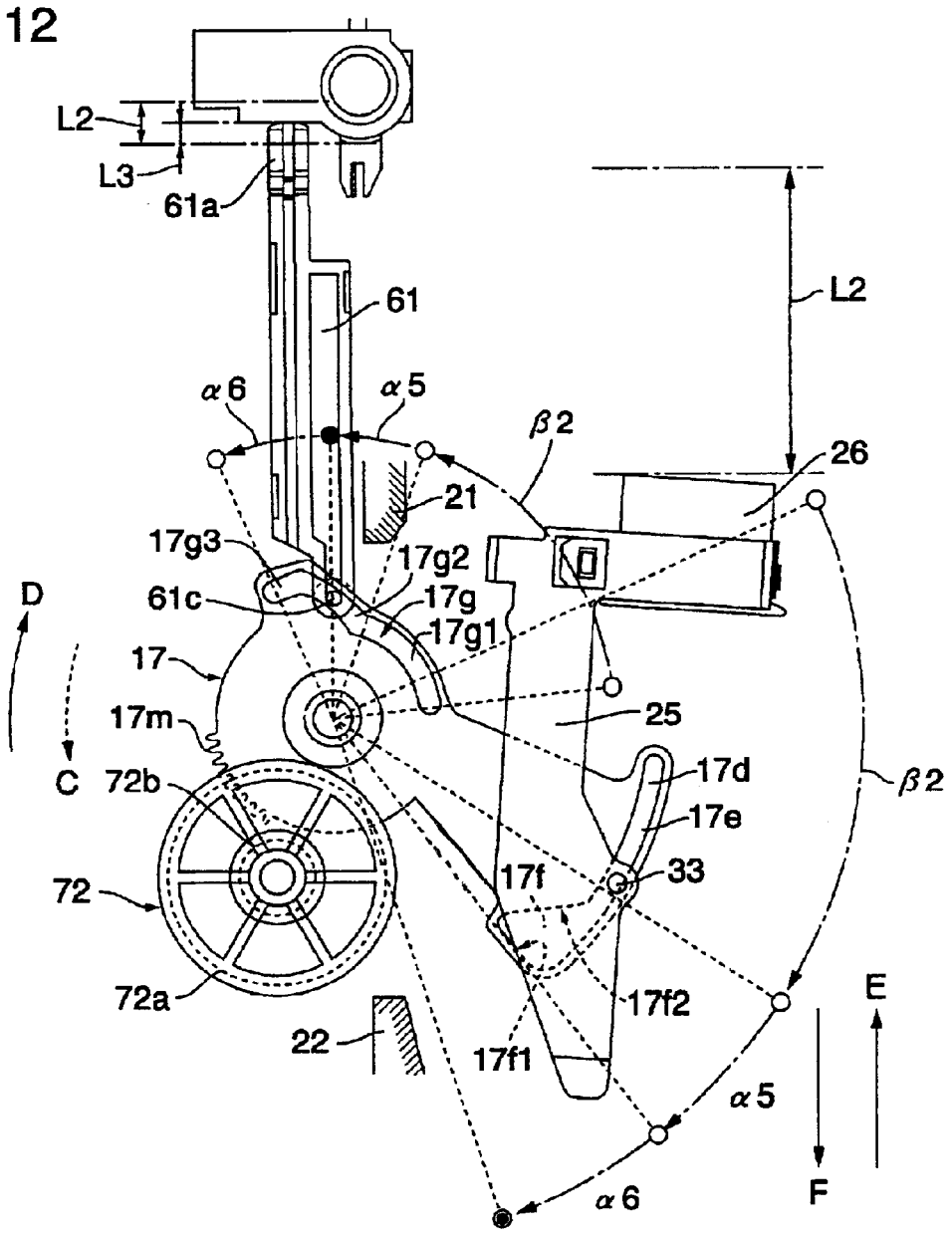
FIG. 12 is an illustration showing positional relationship between a first cam mechanism, a second cam mechanism and a tooth portion of a clutch lever of the cleaning device of FIG. 1, illustrated in a position where the lock lever abuts against the side of the ink-jet head before it reaches its wiping position.

In these drawings, FIG. 7 is an illustration showing positional relationship among the first cam mechanism, the second cam mechanism and the tooth portion of the clutch lever of the cleaning device of FIG. 1. FIGS. 8, 9, 10, 11 and 12 are illustrations showing positional relationship of the cleaner lever 25 and the lock lever 61, wherein FIG. 8 shows the position where the cleaner lever 25 is placed in the retracted position, FIG. 9 shows the cleaner lever 25 and the lock lever 61 is placed in their retracted positions, FIG. 10 shows the position where only the lock lever 61 is placed in the retracted position, FIG. 11 shows a condition where the cleaner lever 25 placed in the wiping position is being retracted, and FIG. 12 shows the position where the lock lever 61 initiates movement from the retracted position to the lock position.

In these drawings, provided that the center angle of the engaging groove 17g3 of the second cam groove 17f is $\alpha 01$, the center angle of the actuation cam groove 17g2 is $\alpha 02$, the sum of the center angles $\alpha 01$ $\alpha 02$ is a rotational angle $\alpha 1$ and the center angle of the first cam groove 17d is taken as $\beta 1$.

In the shown embodiment, the center angle $\beta 1$ of the first cam groove 17d is set to be greater than the rotational angle $\alpha 1$ of the second cam groove 17g. The first cam groove 17d is set in such a manner that when the second cam follower 61c of the lock lever 61 is located at an intersection between the actuation cam groove 17g2 and the arc shaped cam groove 17g1 of the second cam groove 17g, the first cam follower 33 of the cleaner lever 25 comes in contact with the first cam surface 17f1 of the triangular cam 17f (see FIG. 9).

Further, provided that a rotational angle of the first cam surface 17f1 of the first cam groove 17d required for moving the first wiping member 26 of the cleaner lever 25 for a stroke length L2 is $\beta 2$, the center angle $\alpha 2$ of the second arc shaped cam groove 17g1 of the second cam groove 17g is set greater than the rotation angle $\beta 2$.

In addition, the tooth portion 17m formed on the outer peripheral surface of the clutch portion 17b of the clutch lever 17 is arranged to have a predetermined angular interval $\Theta o$ from the first cam surface 17f1 of the triangular cam groove 17f (see FIG. 7). The predetermined angle is variable depending upon a relative arrangement with respect to the cleaner lever 25 or the lock lever 61, but is preferably within a range of 0° to 90°, such as 70°.

Also, the angular range $\Theta 1$ where the teeth portion 17m is formed is also related to the moving distance of the cleaner lever 25 or the lock lever 61 and various parameters of tooth profile, and is set at about 54°, for example.

(Operation of Cleaning Device)

Next, operation in the shown embodiment of the cleaning device 10 of the ink-jet printer 1 will be discussed.

Non-Printing Condition (Lock Condition)

At first, a non-printing (resting) condition, as shown in FIG. 8, the clutch lever 17 stays at a position where it is in contact with the second engaging portion 22 on the lower side of the housing 11. At this condition, the cleaner lever 25 is in the retracted position lowered from the wiping position by the stroke length L2. The first cam follower 33 of the cleaner lever 25 is located at the upper end of the first arc shaped cam groove 17e formed on the outer peripheral portion of the lever portion 17c of the clutch lever 17.

In the non-printing condition, the lock lever 61 is located at the lock position elevated by the stroke length L1 from the retracted position, so that it engages with a lock groove (not shown) provided on the carriage 82 mounting the ink-jet head 2 to lock the ink-jet head 2 (in the shown example, the carriage 82 mounting the ink-jet head 2 is locked). At this time, the second cam follower 61c of the lock lever 61 is located within the engaging groove 17g3 in the second cam groove 17g formed on the outer peripheral portion of the clutch portion 17b of the clutch lever 17.

In this non-printing condition, the tooth portion 17m formed on the outer peripheral surface of the clutch portion 17b of the clutch lever 17 is not in engagement with the small diameter gear 72b of the steped gear 72. Accordingly, a driving force from the driving motor 71 is transmitted by a friction force between the clutch portion 17b and the pump gear 16, the friction force being created by a biasing force of a compression coil spring 81 on the pump gear 16.

However, in this condition, since the clutch lever 17 is in contact with the second engaging portion 22 on the lower side of the housing, even when a driving force is applied to the clutch lever 17 to rotate toward the portion 22, slip is caused between the clutch lever 17 and the rotating pump gear 16. Accordingly, only the pump unit 14 is driven by the pump gear 16, to thereby enable suction operation of ink, bubble and so forth from the ink nozzles arranged on the nozzle surface 3 of the ink-jet head 2.

Next, in the non-printing condition (locking condition), when the clutch lever 17 is pivoted upward by the driving motor 71, the locking condition by the locking lever 61 is released. More specifically, as shown in FIG. 9, the clutch lever 17 is rotated by the rotational angle $\alpha 1$ in a direction shown by arrow C from the position where the clutch lever 17 is in contact with the second engaging portion 22.

By rotation of the clutch lever 17, the lock lever 61 at the lock position is lowered by the stroke length L1 to reach the retracted position. Namely, the second cam follower 61c of the lock lever 61 is pushed downward by the actuation cam groove 17g2 of the second cam groove 17g formed thereon associating with rotation of the clutch portion 17b of the clutch lever 17. Then, the cam follower 61c reaches a boundary between the actuation cam groove 17g2 and the second arc shaped cam groove 17g1.

In contrast to this, the cleaner lever is held at the retracted position which is below the wiping position by the stroke length L2. Namely, the first cam follower 33 of the cleaner lever 25 slides along the first arc shaped cam groove 17e formed on the outer peripheral portion of the lever portion 17c of the clutch lever 17. Thus, even when the clutch lever 17 is rotated, the first cam follower 33 will not move. After rotation of the clutch lever 17 over the rotational angle $\alpha 1$, the first cam follower 33 of the cleaner lever 25 reaches the boundary between the arc shaped cam groove 17e and the first cam surface 17f1 of the triangular cam groove 17f.

On the other hand, when the clutch lever 17 is rotated over the rotational angle $\alpha 1$, the tooth portion 17*m* formed on the outer peripheral surface of the clutch portion 17*b* of the clutch lever 17 transits to a meshing condition with the small gear 72*b* of the stepped gear 72.

Thus, in the condition where lock is released, it is allowed for the ink-jet head 2 mounted on the carriage 82 to move reciprocally in the directions of arrow A and B (see FIG. 1) to perform printing on the fed printing paper.

Nozzle Surface Wiping Condition

When the nozzle surface 3 of the ink-jet head 2 is wiped by means of the elastic wiping blade 26, the clutch lever 17 is rotated over a rotational angle ($\alpha 1+\beta 2$) in the direction shown by arrow C from the position contacting with the second engaging portion 22 of the housing 11, as shown in FIG. 10. After rotation, the clutch lever 17 comes into contact with the first engaging portion 21 at the upper side of the houisng.

Upon rotation of the clutch lever 17, a rotational torque of the driving motor 71 is transmitted to the clutch lever 17 by a frictional force between the pump gear 16 and the clutch lever 17, and at the same time is directly transmitted via meshing between the tooth portion 17*m* formed on the outer peripheral surface of the clutch lever 17 and the small diameter gear 72*b*. Therefore, even when external force is applied, the clutch lever 17 can be certainly driven to rotate.

Also, upon rotation of the clutch lever 17, the first cam follower 33 of the cleaner lever 25 is pushed upward as shown by arrow E by the first cam surface 17*f*1 of the first cam groove 17*d* formed on the outer periphery portion of the lever portion 17*c* of the clutch lever 17 by the stroke length L2.

The tooth portion 17*m* formed on the outer peripheral surface of the clutch portion 17*b* of the clutch lever 17 becomes disengaged from the smaller gear 72*b* at a timing before the clutch lever 17 has been rotated by ($\alpha 1+\beta 2$). Thereafter, the clutch lever 17 is transmitted rotational torque by the frictional force between it and the pump gear 16, so that it lifts up the cleaner lever 25 by the rotational torque.

Thus, the cleaner lever 25 reaches the wiping position where the nozzle surface 3 can be wiped. In this condition, the first supporting projection 31 and the second supporting projection 32 of the cleaner lever 25 are located in the corner groove 43 arranged in the horizontal direction from the upper end of the first guide groove 41 and the upper end of the second guide groove 42, respectively. The projecting portion 25*d* projecting from the lever portion 26*b* of the cleaner lever 25 laterally is engaged into the engaging groove 44 provided at the upper portion of the corner groove portion 43. As a result, the cleaner lever can be maintained stably at the wiping position.

After lifting the cleaner lever 25 at the wiping position, the ink-jet head 2 is reciprocated in the directions of arrows A and B shown in FIG. 1 with respect to the elastic wiping blade 26 mounted on the upper end of the cleaner lever 25. As a result, the ink, paper dust and so forth may be wiped off the nozzle surface 3 by the elastic wiping blade 26.

When the cleaner lever 25 is elevated, the second cam follower 61*c* of the lock lever 61 slides along the second arc shaped cam groove 17*g*1 of the second cam groove 17*g* formed on the outer peripheral portion of the clutch portion 17*b* of the clutch lever 17. Accordingly, irrespective of the rotation of the clutch lever 17, the lock lever 61 is not moved and stays at the retracted position.

Retracting Operation of Cleaner Lever

Next, when printing operation is performed after finishing cleaning of the nozzle surface 3, the cleaning lever 25 has to be retracted in the direction of arrow F from the wiping position. FIG. 11 shows a condition immediately after lowering of the cleaner lever 25.

In this case, the first cam follower 33 of the cleaner lever 25 is pushed by the second cam surface 17*f*2 of the triangular cam groove 17*f* formed on the outer peripheral portion of the lever portion 17*c* of the clutch lever 17.

The first cam surface 127*f*1 and the second cam surface 17*f*2 of the triangular cam groove 17*f* are arranged with a predetermined angle $\gamma 0$. Accordingly, after the clutch lever 17 is rotated by the rotational angle $\gamma 1$ in the direction shown by arrow D from the position where it is in contact with the engaging portion 21 of the housing 11, the first cam follower 33 of the cleaner lever 25 contacts with the cam surface 17*f*2 of the clutch lever 17. Subsequently, the cleaner lever 25 is pushed by cam surface 17*f*2 to move.

This angle $\gamma 0$ is related to arrangement of the cleaner lever 25 and the clutch lever 17, and is preferably set to be greater than or equal to 0° (wherein 0 is a condition where the cam surface 17*f*1 and the cam surface 17*f*2 are parallel), and 55°, for example.

When the clutch lever 17 is rotated by $\gamma 0$, the tooth portion 17*m* formed on the outer peripheral surface of the clutch portion 17*b* of the clutch lever 17 becomes meshed with the small diameter gear 72*b* of the stepped gear 72. After meshing condition is established, the driving force of the driving motor 71 is transmitted to the clutch lever 17 not only via the frictional force between the clutch portion 17*b* of the clutch lever 17 and the pump gear 16, but also via the meshing between the tooth portion 17*m* and the gear 72*b*. This assures steady power transmission from the driving motor 71 to the clutch lever 17. It should be noted that the lock lever 61 stays at the retracted position. As is aforementioned, the clutch lever 17 is retracted to the position shown in FIG. 9, again.

Operation upon Lock Impossible Condition

Since position control of the ink-jet head 2 for printing has a significant influence to printing quality, high precision control method is employed for the position control of the head. However, when unexpectedly large external force or the like is applied, there is a possibility that the ink-jet head 2 cannot be controlled to stop at a position to be locked by the lock lever 61.

In this case, even if the lock lever 61 is elevated up for locking the ink-jet head 2, the tip end of the lock lever 61 may contact at a portion different from the lock groove (not shown) of the ink-jet head 2, preventing the lock lever 61 from moving upward any further.

In the shown embodiment, when the lock lever 61 is elevated, the second cam follower 61*c* of the lock lever 61 slides along the actuation cam groove 17*g*2 in the second cam groove 17*g* formed on the outer peripheral portion of the clutch portion 17*b* of the clutch lever 17. Accordingly, when the lock lever 61 does not engage with the lock groove on the side of the ink-jet head 2 but contacts with any other portion, the can follower 61*c* is located at the intermediate position of the actuation cam groove 17*g*2.

At this condition, as shown in FIG. 12, the tooth portion 17*m* provided on the outer peripheral surface of the clutch portion 17*b* of the clutch lever 17 does not mesh with the smaller diameter gear 72*b* of the stepped gear 72. The driving force is transmitted only by the friction force between the clutch portion 17*b* of the clutch lever 17 and the pump gear 16, the friction force being generated by biasing force of the compression coil spring 81 on the pump gear 16. Accordingly, when the lock lever 61 contacts with the surface of the ink-jet head 2 before the lock lever 61 reaches the lock position, slip is generated between the pump gear 16 and the clutch lever 17 so as not to lift the lock lever 61 upward, whereby the ink-jet head 2 is prevented from being damaged by the lock lever 61.

As aforementioned, in the cleaning device 10 of the shown embodiment, the first cam surface 17*f*1 and the second cam surface 17*f*2 of the triangular cam groove 17*f* formed on the outer peripheral surface of the lever portion 17*c* of the clutch lever 17 are arranged to form a predetermined angle with each other so as to provide a large angle between the second cam surface 17*f*2 and the corner groove portion 43. As a result, only by rotational motion of the clutch lever 17, the cleaner lever 25 can be smoothly moved along the first guide groove 41 extending vertically and the corner groove portion 43 extending horizontally from the upper end of the first guide groove 41.

On the other hand, the power transmission path to the clutch lever 17 in the shown embodiment of the cleaning device 10 has two systems. One forms a transmission path by the friction force between the pump gear 16 and the clutch lever 17, and the other a transmission path by meshing between the tooth portion 17*m* formed on the outer peripheral surface of the clutch portion 17*b* of the clutch lever 17 and the small diameter gear 72*b* of the stepped gear 72.

The power transmission path by meshing is limited to a predetermined rotational angular range of the clutch lever 17. In other words, the driving transmission path by meshing is established only when the cleaner lever 23 moves along a limited intermediate portion of the vertical moving path thereof.

Accordingly, for example, even when the ink-jet head 2 cannot be stopped at the predetermined position for engaging with the lock lever and the lock lever 61 contacts with the ink-jet head 2 undesirably, only slip is generated between the frictional surfaces between the clutch portion 17*b* of the clutch lever 17 and the pump gear 16. Thus, even if unnecessarily large amount of driving control signal is output to the driving motor 71, damage to the respective parts can be avoided. Further, recovery control from such locking disabled conditions can be simplified.

On the other hand, within the meshing condition between the tooth portion 17*m* and the small diameter gear 72*b* of the stepped gear 72, the driving force is transmitted via the gear meshing as well as by means of the frictional force, so that the power from the driving motor 71 can steadily be transmitted. For example, when the cleaner lever 25 is temporarily stopped at an intermediate position when retracting, the cleaner lever 25 can be stopped precisely in comparison with the case where the clutch lever 17 is moved by a driving force transmitted only by means of the friction force. In addition, sufficient driving force to move the clutch lever 17 can easily be obtained.

In particular, in the shown embodiment, while the elastic wiping blade 26 moves in a condition contacting with the elastic sub-blade 51, the driving force from the driving motor 71 is transferred to the cleaner lever 25 via the meshing transmission path. This enables to move the cleaner lever 25 steadily even if the cleaner lever 25 is applied with a large load due to the frictional contact between the both blades 25 and 51. (The detailed wiping operation of the elastic sub-blade 51 will be discussed hereinafter.)

Furthermore, in the shown embodiment of the cleaning device 10, when the lock lever 61 is moved by the second cam groove 17*g*, the clutch lever 17 disables movement of the cleaner lever 25 by the first arc shaped cam groove 17*e* of the first cam groove 17*d*, and when the cleaner lever 25 is moved by the first cam groove 17*d*, the lock lever 61 is prevented from moving by the second arc shaped cam groove 17*g*1 of the second cam groove 17*g*. Accordingly, by rotation of the clutch lever 17, only one of the cleaner lever 25 and the lock lever 61 can be moved. Therefore, the stroke length L2 of the cleaner lever and the stroke length L1 of the lock lever 61 can be reduced to a necessary minimum length.

Accordingly, it is required for the housing 11 to obtain necessary space only for the stroke length L2 of the cleaner lever 25 and the stroke length L1 of the lock lever 61, which contributes to down-sizing of the cleaning device 10 per se.

Furthermore, since which of the cleaner lever 25 and the lock lever 61 is moved, depends on the rotational direction of the clutch lever 17, the control for controlling revolution of the driving motor 71 can be simplified.

Particularly, in the shown embodiment, when the lock lever 61 is located at boundary portion P between the region to move the lock lever 61 (actuation cam groove 17*g*2) and the region not to move (second arc shaped cam groove 17*g*1), the cleaner lever 25 is located at a boundary portion between a region where the cleaner lever 25 is not moved (first arc shaped cam groove 17*e*) and a region where the cleaner lever 25 is moved (cam surface 17*f*1). Accordingly, when the clutch lever 17 is rotated, either one of the lock lever 61 or the cleaner lever 25 is inevitably moved. Therefore, pivoting amount of the clutch lever 17 can be reduced to the necessary minimum amount. As a result, the driving control mechanism of the lock lever and the clutch lever can be further simplified.

In addition, in the shown embodiment, with maintaining immovable condition of the lock lever 61, the elastic wiping blade 26 of the cleaner lever 25 can be retracted in the vicinity of the lower side of the elastic sub-blade 51. Therefore, a period to place the elastic wiping blade 26 of the cleaner lever 25 close to the nozzle surface 3 of the ink-jet head 2, can be shortened.

(Wiping Operation by Elastic Sub-Blade)

Next, operation of the elastic sub-blade 51 is discussed when the elastic wiping blade 26 mounted on the cleaner lever 25 is moved vertically.

As mentioned before, in the condition where the elastic wiping blade 26 is arranged within the blade receptacle portion 45 of the housing 11, the upper opening of the blade receptacle portion 45 is covered by the elastic sub-blade 51. Accordingly, even when the foreign matter, such as paper dust or the like drops from the nozzle surface 3 of the ink-let head 2 reciprocating above the elastic sub-blade, such foreign matter is captured by the elastic sub-blade 51 so as not to deposit on the elastic wiping blade 26.

When the elastic wiping blade 26 mounted on the upper end of the cleaner lever 25 is moved upward, the first blade portion 26*c* contacts with the elastic sub-blade 51 in an inclined state as shown in FIG. 6A. Thus, at first, one end of the first blade portion 26*c* (left side in FIG. 3) comes in contact with the lower surface of the elastic sub-blade 51. Subsequently, line contact portion between the first blade portion 26*c* and the elastic sub-blade 51 is gradually expanded to the other side end portion of the first blade portion 26*c*.

On the other hand, the elastic sub-blade 51 is pushed up at the left side portion by the elastic wiping blade 26. Thereafter, the elastic sub-blade 51 is flexed to bow over the first blade portion 26*c* of the elastic wiping blade 26. By this, as shown in FIG. 6B, the elastic wiping blade 26 is rubbed out the foreign matter carried thereon by the lower surface of the elastic sub-blade 51. At the same time, the elastic sub-blade 51 is deflected upwardly at its portion of L1 extended from the second support member 47 of the blade supporting portion 46.

According to movement of the cleaner lever 25, the elastic sub-blade 51 maintains substantially, in the deflected state with a radius of R1 and rubs off the foreign matter on the rubber member 26*a* of the elastic wiping blade 26 and the metal blade 27. By this, not only the foreign matter deposited on the first blade portion 26*c* of the elastic wiping blade 26 but also those deposited on the rubber member 26*a* of the elastic wiping blade 26 and those deposited on the metal blade 27 can be scraped off.

With respect to the elastic wiping blade 26, foreign matter on which is wiped by the elastic sub-blade 51, the ink-jet head 2 is reciprocally moved as shown by arrows A and B (see FIG. 1). By this, the elastic wiping blade 26 removes the ink with increased viscosity, paper dust and so forth deposited on the nozzle surface 3. Namely, upon moving the ink-jet head 2 from the cleaning position shown in FIG. 1 to the printing region in the direction of arrow B, the nozzle surface 3 is wiped by the rubber member 26*a*, and upon moving the ink-jet head 2 from the printing region to the cleaning position in the direction of arrow A, the nozzle surface 3 is rubbed by the felt member 26*b*.

When the cleaner lever 25 is lowered after completion of cleaning of the nozzle surface 3 of the ink-jet head 2, the third blade portion 27*a* of the metal blade 27 contacts with the elastic sub-blade 51 in tilted condition. As a result, the foreign manner deposited on the upper surface of the elastic sub-blade 51 or the second blade portion 51*a* is scraped and drops into the blade receptacle portion 45.

On the other hand, as shown in FIG. 6C, according to lowering of the cleaner lever 25, the elastic sub-blade 51 deflects downwardly at the portion of the length L2 projecting from the first support member 48 of the frame supporting body 48. Throughout the period contacting with the elastic wiping blade 26, the deflected condition with a curve radius R2 which is greater than the curve radius R1 is substantially maintained.

In this case, a load which the elastic wiping blade 26 receives from the elastic sub-blade 51 of the curve radius R2 is smaller than that received from the elastic sub-blade 51 of the curve radius R1. Therefore, the frictional force applied on the elastic wiping blade 26 upon lowering of the cleaner blade 25 becomes smaller than the frictional force on the elastic wiping blade 26 upon ascending the cleaning lever 25. Likewise, the load which the elastic sub-blade 51 receives from the elastic wiping blade 26 is smaller at the downward movement. Therefore, the frictional force applied on the elastic sub-blade 51 upon lowering of the cleaner lever is smaller than that on the elastic sub-blade 51 upon elevating the cleaner lever 25.

As mentioned above, by covering the upper side of the elastic wiping blade 26 with the elastic sub-blade 51, it is possible to prevent deposition of the paper dust or the like on the elastic wiping blade 26. As a result, upon cleaning of the ink-jet head 2, deposition on the elastic wiping blade 26 can be prevented from being transferred to the nozzle surface 3.

On the other hand, the elastic sub-blade 51 wipes off the deposition on the elastic wiping blade 26 with a large frictional force, and the elastic wiping blade 26 is moved away from the wiping operation with a small frictional force. Therefore, wearing of the elastic wiping blade 26 and the elastic sub-blade 51 can be reduced in comparison with the case where the elastic sub-blade 51 is simply fixed. Thus, the cleaning device 10 can be used for a long period without exchanging the elastic wiping blade 26 or the like.

Particularly, in the shown embodiment, such effect can be obtained with a simple constitution in that the sizes of the members (47, 48) at the upper surface side and the lower surface side of the elastic sub-blade 51 are varied. It should be noted that by forming the support members 47 and 48 as a single member, such effect can be achieved without increasing the number of parts.

Here, one feature of the present invention to differentiate the bending moment generated on the elastic sub-blade 51 between its ascending and descending movement. By differentiating the bending moment M generated on the elastic sub-blade 51, the frictional force generated on the elastic wiping blade 26 and that on the elastic sub-blade 51 can be differentiated.

The bending moment M of the elastic sub-blade 51 can be expressed by the following equation. In the shown embodiment, the curve radius R is differentiated between the cases where the cleaner lever 25 is elevated and where the cleaner lever 25 is lowered. Instead, it is also possible to vary the section (including the sectional shape due to difference of arrangement of the elastic sub-blade 51) between deflecting upward and deflecting downward to differentiate geometrical moment of inertia I or longitudinal elastic coefficient.

$$M=-(E\times I)/R$$

wherein M: bending moment

E: longitudinal elastic coefficient

I: geometrical moment of inertia

R: curve radius.

Also, in the shown embodiment, since the deposition on the elastic sub-blade 51 is scraped off by the third blade 27*a* of the metal blade 27, the deposition on the elastic sub-blade 51 will never be transferred to the elastic wiping blade 26. Therefore, the original function of the elastic wiping blade 26 can be maintained for a long period.

On the other hand, in the shown embodiment, since the first blade portion 26*c* of the elastic wiping blade 26 is contacted with the elastic sub-blade 51 in a tilted state, contacting period between the first blade portion 26*c* and the elastic sub-blade 51 can be prolonged as compared with the case where the first blade portion 26*c* is contacted with the elastic sub-blade 51 in parallel. Furthermore, the elastic sub-blade 51 is deflected on the first blade portion 26*c* to generate large frictional force in the first blade portion, to thereby uniformly remove the deposition on the first blade portion 26*c* of the elastic wiping blade 26.

This is true even between the third blade portion 27*a* of the metal blade 27 and the elastic sub-blade 51. While function is reversed, the operation is the same as the foregoing. Therefore, among the upper surface of the elastic sub-blade 51, such region contacting with the third blade portion 27*a* can be uniformly wiped out.

As aforementioned, the cleaning device according to the present invention can certainly wipe the deposition on the ink nozzle surface of the ink-jet head. Also, the structure of the device can be compact. Accordingly, the ink-jet printer provided with the cleaning device of the present invention can avoid clogging of the ink nozzle by foreign matter depositing on the nozzle surface, whereby high quality printing can be realized. Also, since the cleaning device requires smaller space, compact ink-jet printer can be realized.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A cleaning device for cleaning a nozzle surface of an ink-Jet head, comprising:

a first wiping member for wiping said nozzle surface;

a cleaner lever for supporting said first wiping member;

a lever driving mechanism moving said first wiping member between a retracted position located away from said nozzle surface and a wiping position for wiping said nozzle surface;

a flat plate form second wiping member formed of an elastic body arranged within a moving path of said first wiping member so as to contact with said first wiping member;

a first supporting member supporting said second wiping member on the side of the retracted position of said first wiping member; and a second supporting member supporting, said second wiping member on the side of said wiping position of said first wiping member;

wherein a length of a portion of said second wiping member projecting from said first supporting member is greater than a length of a portion of said second wiping member projecting from said second supporting member.

2. A cleaning device as set forth in claim 1, wherein said first wiping member is designed to move between said retracted position and said wiping position located above said retracted position, by moving a cleaner lever, and said second wiping member is arranged above said retracted position and below said wiping position.

3. A cleaning device as set forth in claim 1, wherein said cleaner lever has a third wiping member which is able to contact with said second wiping member while said cleaner lever is moving.

4. A cleaning device as set forth in claim 1, wherein said lever driving mechanism includes:

a rotary driving source;

a gear train to be driven by said rotary driving source;

a friction type clutch lever which is frictionally engaged with one of gears constituting said gear train by means of a predetermined biasing force and is arranged coaxially with said gear;

a first cam mechanism for converting rotation of said clutch lever into movement of said cleaner lever; and a tooth portion formed on said clutch lever which engages with said gear train when said clutch lever is in a predetermined rotational angular range.

5. A cleaning device as set forth in claim 4, wherein said tooth portion engages with said gear train when said first wiping member is being moved in a condition contacting with said second wiping member.

6. A cleaning device as set forth in claim 4, wherein said first cam mechanism includes a first cam follower formed in said cleaner lever, a first cam surface contacting with said first cam follower while said cleaner lever moves to said wiping position, and a second cam surface contacting with said first cam follower while said cleaner lever moves to said retracted position, and wherein said first and second cam surfaces are arranged at a predetermined angle with respect to each other.

7. A cleaning device as set forth in claim 4, further comprising a lock lever for locking said ink-jet head at a predetermined position, wherein said lever driving mechanism includes a second cam mechanism for converting a rotational force of said rotary driving source into a driving force for moving said lock lever between a locking position for fixing said ink-jet head and an unlocking position away from said ink-let head.

8. A cleaning device as set forth in claim 7, wherein said first cam mechanism includes a first cam follower formed in said cleaner lever, said first cam follower following a first cam region for reciprocally moving said cleaner lever between said wiping position and said retracted position according to rotation of said clutch lever, and a second cam region for holding said cleaner lever at said retracted position even when said clutch lever is rotated, and said second cam mechanism includes a second cam follower formed in said luck lever, said second cam follower following a third cam region for reciprocally moving said lock lever between said locking position and said unlocking position according to rotation of said clutch lever, and a fourth cam region for holding said lock lever at said unlocking position even when said clutch lever is rotated.

9. A cleaning device as set forth in claim 8, wherein while said first cam follower is operated in said first cam region, said second cam follower is in said fourth cam region, and when said first cam follower is moved into said second cam region, said second cam follower is shifted into operation in said third cam region.

10. A cleaning device as set forth in claim 8, wherein said second cam region is defined by an arc shaped cam groove centered at a rotational center of said clutch lever, and said fourth cam region is defined by an arc shaped groove centered at rotational center of said clutch lever.

11. A cleaning device as set forth in claim 7, further comprising an ink pump device for sucking ink from ink nozzles of said ink-jet head; wherein said rotary driving source is a motor for driving said ink pump device.

12. A cleaning device for cleaning a nozzle surface of an ink-jet head, comprising:

a first wiping member for wiping said nozzle surface;

a cleaner lever for supporting said first wiping member;

a lever driving mechanism moving said first wiping member between a retracted position located away from said nozzle surface and a wiping position for wiping said nozzle surface; and a flat plate form second wiping member formed of an elastic body arranged within a moving path of said first wiping member so as to contact with said first wiping member;

wherein said lever driving mechanism includes:

a rotary driving source;

a gear train to be driven by said rotary driving source:

a friction type clutch lever which is frictionally engaged with one of gears constituting said gear train by means of a predetermined biasing force and is arranged coaxially with said gear;

a first cam mechanism for converting rotation of said clutch lever into movement of said cleaner lever; and a tooth portion formed on said clutch lever which engages with said gear train when said clutch lever is in a predetermined rotational angular range.

13. A cleaning device as set forth in claim 12, wherein said tooth portion engages with said gear train when said first wiping member is being moved in a condition contacting with said second wiping member.

14. A cleaning device as set forth in claim 12, wherein said first cam mechanism includes a first cam follower formed in said cleaner lever, a first cam surface contacting with said first cam follower while said cleaner lever moves to said wiping position, and a second cam surface contacting with said first cam follower while said cleaner lever moves to said retracted position, and wherein said first and second cam surfaces are arranged at a predetermined angle with respect to each other.

15. A cleaning device as set forth in claim 12, further comprising a look lever for locking said ink-jet head at a predetermined position, wherein said lever driving mechanism includes a second cam mechanism for converting a rotational force of said rotary driving source into a driving force for moving said lock lever between a locking position for fixing said ink-jet head and an unlocking position away from said ink-jet head.

16. A cleaning device as set forth in claim 15, wherein said first cam mechanism includes a first cam follower formed in said cleaner lever, said first cam follower following a first cam region for reciprocally moving said cleaner lever between said wiping position and said retracted position according to rotation of said clutch lever, and a second cam region for holding said cleaner lever at said retracted position even when said clutch lever is rotated, and said second cam mechanism includes a second cam follower formed in said lock lever, said second cam follower following a third cam region for reciprocally moving said lock lever between said locking position and said unlocking position according to rotation of said clutch lever, and a fourth cam region for holding said lock lever at said unlocking position even when said clutch lever is rotated.

17. A cleaning device as set forth in claim 16, wherein while said first cam follower is operated in said first cam region, said second cam follower is in said fourth cam region, and when said first cam follower is moved into said second cam region, said second cam follower is shifted into operation in said third cam region.

18. A cleaning device as set forth in claim 16, wherein said second cam region is defined by an arc shaped cam groove centered at a rotational center of said clutch lever, and said fourth cam region is defined by an arc shaped groove centered at rotational center of said clutch lever.

19. A cleaning device as set forth in claim 15, further comprising an ink pump device for sucking ink from ink nozzles of said ink-jet head; wherein said rotary driving source is a motor for driving said ink pump device.

20. A cleaning device for cleaning a nozzle surface of an ink-jet head, comprising:

a first wiping member for wiping said nozzle surface;

a cleaner lever for supporting said first wiping member; and a lever driving mechanism moving said first wiping member between a retracted position located away from said nozzle surface and a wiping position for wiping said nozzle surface; wherein said lever driving mechanism includes:

a rotary driving source;

a gear train to be driven by said rotary driving source;

a friction type clutch lever which is frictionally engaged with one of gears constituting said gear train by means of a predetermined biasing force and is arranged coaxially with said gear;

cam mechanism converting rotation of said clutch lever into movement of said cleaner lever; and a tooth portion formed on said clutch lever which engages with said gear train when said clutch lever is in a predetermined rotational angular range.

21. A cleaning device as set forth in claim 20, wherein said cam mechanism includes a first cam follower formed in said cleaner lever, a first cam surface contacting with said first cam follower while said cleaner lever moves to said wiping position, and a second cam surface contacting with said first cam follower while said cleaner lever moves to said retracted position, and wherein said first and second cam surfaces are arranged at a predetermined angle with respect to each other.

22. A cleaning device as set forth in claim 20, wherein said cam mechanism includes a cam follower formed in said cleaner lever, said cam follower following a first cam region for reciprocally moving said cleaner lever between said wiping position and said retracted position according to rotation of said clutch lever, and a second cam region for holding said cleaner lever at said retracted position even when said clutch lever is rotated.

23. A cleaning device as set forth in claim 22, wherein said second cam region is defined by an arc shaped cam groove centered at a rotational center of said clutch lever.

24. A cleaning device for cleaning a nozzle surface of an ink-jet head, comprising:

a lock lever for locking said ink-jet head at a predetermined position; and, a lever driving mechanism for moving said lock lever between a locking position for fixing said Ink-jet head and an unlocking position away from said ink-jet head, wherein said lever driving mechanism includes:

a rotary driving source;

a gear train to be driven by said rotary driving source;

a friction type clutch lever which is frictionally engaged with one of gears constituting said gear train by means of a predetermined biasing force and is arranged coaxially with said gear;

cam mechanism for converting rotation of said clutch lever into movement of said lock lever; and a tooth portion formed on said clutch lever which engages with said gear train when said clutch lever is in a predetermined rotational angular range.

25. A cleaning device as set forth in claim 24, wherein said cam mechanism includes a cam follower formed in said lock lever, said cam follower following a third cam region for reciprocally moving said lock lever between said locking position and said unlocking position according to rotation of said clutch lever and a fourth cam region for holding said lock lever at said unlocking position even when said clutch lever is rotated.

26. A cleaning device as set forth in claim 25, wherein said fourth cam region is defined by an arc shaped groove centered at rotational center of said clutch lever.

27. A cleaning device for cleaning a nozzle surface of an ink-jet head, comprising:

a first wiping member for wiping said nozzle surface;

a cleaner lever for supporting said first wiping member;

a lock lever for locking said ink-jet head at a predetermined position; and a lever driving mechanism which moves said first wiping member between a retracted position located away from said nozzle surface and a wiping position for wiping said nozzle surface, and moves said lock lever between a locking position for fixing said ink-jet head and an unlocking position away from said ink-jet head, wherein said lever driving mechanism includes:

a rotary driving source;

a gear train to be driven by said rotary driving source;

a friction type clutch lever which is frictionally engaged with one of gears constituting said gear train by means of a predetermined biasing force and is arranged coaxially with said gear;

a first cam mechanism for converting rotation of said clutch lever into movement of said cleaner lever; and a second cam mechanism for converting rotation of said clutch lever into movement of said lock lever.

28. A cleaning device as set forth in claim 27, wherein said first cam mechanism includes a first cam follower formed in said cleaner lever, said first cam follower following a first cam region for reciprocally moving said cleaner lever between said wiping position and said retracted position according to rotation of said clutch lever, and a second cam region for holding said cleaner lever at said retracted position even when said clutch lever is rotated, and said second cam mechanism includes a second cam follower formed in said lock lever, said second cam follower following a third cam region for reciprocally moving said lock lever between said locking position and said unlocking position according to rotation of said clutch lever and a fourth cam region for holding said lock lever at said unlocking position even when said clutch lever is rotated.

29. A cleaning device as set forth in claim 28, wherein while said first cam follower is operated in said first cam region, said second cam follower is in said fourth cam region, and when said first cam follower moved into said second cam region, said second cam follower is shifted into operation in said third cam region.

30. A cleaning device for cleaning a nozzle surface of an ink-jet head, comprising:

a first wiping member for wiping said nozzle surface;

a cleaner lever for supporting said first wiping member;

a lever driving mechanism moving said first wiping member between a retracted position located away from said nozzle surface and a wiping position for wiping said nozzle surface; and a flat plate form second wiping member formed of an elastic body arranged within a moving path of said first wiping member so as to contact with said first wiping member:

wherein a tip end surface of said first wiping member first comes in substantially perpendicular contact with a side surface of said second wiping member and then moves across said side surface, wherein said lever driving mechanism includes:

a rotary driving source;

a gear train to be driven by said rotary driving source;

a friction type clutch lever which is frictionally engaged with one of gears constituting said gear train by means of a predetermined biasing force and is arranged coaxially with said gear;

a first cam mechanism for converting rotation of said clutch lever into movement of said cleaner lever; and a tooth portion formed on said clutch lever which engages with said gear train when said clutch lever is in a predetermined rotational angular range.

31. A cleaning device as set forth in claim 30, wherein said tooth portion engages with said gear train when said first wiping member is being moved in a condition contacting with said second wiping member.

32. A cleaning device as set forth in claim 30, wherein said first cam mechanism includes a first cam follower formed in said cleaner lever, a first cam surface contacting with said first cam follower while said cleaner lever moves to said wiping position, and a second cam surface contacting with said first cam follower while said cleaner lever moves to said retracted position, and wherein said first and second cam surfaces are arranged at a predetermined angle with respect to each other.

33. A cleaning device as set forth in claim 30, further comprising a lock lever for locking said ink-jet head at a predetermined position, wherein said lever driving mechanism includes a second cam mechanism for converting a rotational force of said rotary driving source into a driving force for moving said lock lever between a locking position for fixing said ink-jet head and an unlocking position away from said ink-jet head.

34. A cleaning device as set forth in claim 33, wherein said first cam mechanism includes a first cam follower formed in said cleaner lever, said first cam follower following a first cam region for reciprocally moving said cleaner lever between said wiping position and said retracted position according to rotation of said clutch lever, and a second cam region for holding said cleaner lever at said retracted position even when said clutch lever is rotated, and said second cam mechanism includes a second cam follower formed in said lock lever, said second cam follower following a third cam region for reciprocally moving said lock lever between said locking position and said unlocking position according to rotation of said clutch lever, and a fourth cam region for holding said lock lever at said unlocking position even when sad clutch lever is rotated.

35. A cleaning device as set forth in claim 34, wherein while said first cam follower is operated in said first cam region, said second cam follower is in said fourth cam region, and when said first cam follower is moved into said second cam region, said second cam follower is shifted into operation in said third cam region.

36. A cleaning device as set forth in claim 34, wherein said second cam region is defined by an arc shaped cam groove centered at a rotational center of said clutch lever, and said fourth cam region is defined by an arc shaped groove centered at rotational center of said clutch lever.

37. A cleaning device as set faith in claim 33, further comprising an ink pump device for sucking ink from ink nozzles of said ink-jet head; wherein said rotary driving source is a motor for driving said ink pump device.

38. An ink-jet printer comprising:

an ink-jet head;

a cleaning device which is arranged offsetting from a printing region of said ink-jet head and is defined in any one of claims 1, 12 to 29 and 2 to 37; and a carriage carrying said ink-jet head for reciprocally moving along a moving path through said printing region and a position opposing to said cleaning device.

* * * * *